US006208084B1

(12) United States Patent
Urakabe et al.

(10) Patent No.: US 6,208,084 B1
(45) Date of Patent: Mar. 27, 2001

(54) DISPLAY DEVICE INCLUDING DISPLAY PANEL USING AC DISCHARGE

(75) Inventors: Takahiro Urakabe; Takashi Hashimoto; Akihiko Iwata, all of Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/452,382

(22) Filed: Dec. 1, 1999

(30) Foreign Application Priority Data

Dec. 1, 1998 (JP) ..... 10-341960

(51) Int. Cl.[7] ..... G09G 3/10

(52) U.S. Cl. ..... 315/169.4; 315/169.1; 345/68; 345/90

(58) Field of Search ..... 315/169.4, 169.1, 315/169.2; 345/41, 55, 67, 68, 90

(56) References Cited

U.S. PATENT DOCUMENTS 3,976,993 * 8/1976 Hirose et al. ..... 315/169 X
5,430,458 * 7/1995 Weber ..... 345/60
5,684,499 * 11/1997 Shimizu et al. ..... 345/60

FOREIGN PATENT DOCUMENTS 5-82101 4/1993 (JP) .
7-160218 6/1995 (JP) .

OTHER PUBLICATIONS

Owaki, et al., pp. 20–23 and 36–39, "Plasma Display", Nov. 15, 1983.

* cited by examiner

*Primary Examiner*—Haissa Philogene
(74) *Attorney, Agent, or Firm*—Oblon, Spivak, McClelland, Maier & Neustadt, P.C.

(57) ABSTRACT

A wall-voltage generation period is provided once in every several tens or hundreds of frames. A wall voltage (broken line) generated in the wall-voltage generation period does no disappear irrespective of the presence or absence of discharge emission. The presence or absence of discharge emission is controlled by varying the baseline of a voltage across electrodes (solid line) depending on variations in an address voltage (Va) during a display period. The number of priming reset discharges which has been necessary at least once in each frame can be reduced.

15 Claims, 19 Drawing Sheets

DISPLAY DEVICE INCLUDING DISPLAY PANEL USING AC DISCHARGE

BACKGROUND OF THE INVENTION

1. Field of the Invention

The present invention relates to a display device comprising a display panel using ac discharge.

2. Description of the Background Art

As a conventional display panel using ac discharge, an ac plasma display panel (hereinafter referred to as a "PDP") has been well known. The ac PDP includes a two-electrode opposite discharge type and a three-electrode surface discharge type. We will first describe the two-electrode opposite discharge type. FIG. 17 is an exploded perspective view showing the structure of a conventional ac PDP, which is described for example in Owaki et. al., "Plasma Display", Kyoritsu Publishing, p. 21 (hereinafter referred to as a "reference 1"). A conventional ac PDP 1 is produced by bonding two glass substrates 2 on which various members are formed. The two glass substrates 2 are provided in parallel with a predetermined gap therebetween. Assuming that the surface of the glass substrate 2 on the gap side is the inner surface and the surface on the opposite side is the outer surface, sealing glass 6 is formed on the inner periphery of the inner surface of the glass substrate 2. A gap surrounded by the sealing glass 6 is sealed and filled with discharge gas. Hereinafter the glass substrate 2 closer to a display viewer is referred to as a front glass substrate 2 and the other as a rear glass substrate 2. Strip electrodes 3*a* on the inner surface of the front glass substrate 2 are usually transparent electrodes. This is for the purpose of admitting light, which is produced in the gap between the two glass substrates 2, to the front through the front glass substrate 2. On the inner surface of the rear glass substrate 2, strip electrodes 3*b* are formed which are orthogonal to the electrodes 3*a* when the glass substrate 2 is seen through from the front. The strip electrodes 3*a* formed in an area surrounded by the sealing glass 6 on the front glass substrate 2 are covered with a dielectric layer 4, which is then covered with a protective layer 5. Similarly, the rear glass substrate 2 is provided with a dielectric layer 4 which covers the electrodes 3*b* and a protective layer 5 which covers the dielectric layer 4.

For monochrome display using emitted colors of discharge gas itself, discharge is induced at the intersections of the strip electrodes 3*a*, 3*b* in the above structure. Color display, on the other hand, requires additional three kinds of phosphors which emit red, green, and blue lights, respectively, depending on the light (e.g., ultraviolet ray) produced by discharge, besides the above structure. For color display, each intersection of the electrodes 3*a*, 3*b* is coated with a phosphor of one color and three emitted colors of adjacent phosphors are mixed to be a point (pixel) representing various colors. The combination of such points allows acquisition of any desired image in color display.

Now, we will describe the driving principle of a conventional two-electrode opposite discharge type ac PDP. FIG. 18 shows variations in the voltage across electrodes, variations in the wall voltage, and the waveform of light emission, all in the two-electrode opposite discharge type ac PDP. These waveforms are disclosed for example in the above reference 1. The wall voltage is a voltage generated by charge accumulated on the walls of discharge cells. The voltage waveform across electrodes varies with three periods, i.e., address period (writing), sustained discharge period (sustaining), and reset period (erasing), even in one cycle of a driving sequence. The amplitude baselines of a write pulse WPu, a sustain voltage pulse SPu, and an erase pulse EPu in the address, sustain discharge, and reset periods, respectively, are 0V. The write pulse WPu has a write voltage Vwr larger than a firing voltage Vf in amplitude. The sustain voltage pulse SPu has a sustain voltage Vs larger than a discharge sustain voltage Vsm in amplitude. The erase pulse EPu has an erase voltage Ve in amplitude.

With the wall voltage brought to 0V by the erase pulse, a driving sequence starts with no discharge and no light emission. When the write pulse WPu larger in amplitude than the sustain voltage pulse SPu is applied across the electrodes 3*a*, 3*b*, discharge occurs in cells, which produces light. Then, charge is transferred to the surface of the dielectric layer 4 which covers the electrodes 3*a*, 3*b*, This causes charge-up and a reverse voltage in the cells, thus stopping discharge. At this time, the accumulated charge on the surface of the dielectric layer 4 generates a wall voltage Vw. In cells where no write pulse WPu is applied and no write discharge occurs, the wall voltage Vw does not appear.

After the address period, a sustain voltage pulse HPu (−Vs), opposite in polarity from the write pulse WPu, is applied across the electrodes 3*a*, 3*b*. This generates a voltage equal to a sum of the wall voltage Vw and the sustain voltage Vs from the outside, in the discharge cells. The reference Vw indicates the value of the wall voltage as well as the wall voltage itself. The resultant voltage (|Vw|+|Vs|) is large enough to induce discharge, so discharge occurs again to produce light. At this time, a wall voltage Vw, opposite in polarity from that in writing, is developed in the discharge cells.

Further, a sustain voltage pulse SPu (Vs), opposite in polarity from that before a half cycle, is applied across the electrodes 3*a*, 3*b*. This generates a voltage equal to the sum of the wall voltage Vw and the sustain voltage Vs (|Vw|+|Vs|), whereby discharge occurs again. During the sustain discharge period, every application of the sustain voltage pulse SPu generates a potential of |Vw|+|Vs| and discharge is repeated. The discharge repeated during the sustain discharge period is referred to as "sustain discharge". The sustain discharge stops when the wall voltage Vw becomes almost 0 V due to weak discharge caused by the erase pulse EPu in the discharge cells. The erase pulse EPu includes two types: wide and low-voltage type which is large in width and small in amplitude; and narrow and high-voltage type which is small in width and large in amplitude. Here, high/low in the voltage indicates that the voltage is higher or lower than the sustain voltage Vs, respectively. The former type is the driving condition of the aforementioned two-electrode opposite discharge type ac PDP, and the latter type is the driving condition of a three-electrode surface discharge type ac PDP which will be described later.

It is found from the above description that it is important to erase the wall voltage down to 0V in all discharge cells before the address (write) discharge in the conventional display panels. If the wall voltage Vw in the discharge cells before the address discharge is not 0 V, undesirable discharge may occur in the unselected cells or necessary discharge may not occur in the selected cells. This insufficient erasing is one of the big factors behind reduction in the driving margin.

Now, we will describe a conventional driving principle of a three-electrode surface discharge type ac PDP. FIG. 19 shows voltage waveforms across electrodes to explain how to drive the PDP, which is described for example in Japanese Patent Laid-open No. P07-160218A. As shown, voltages of different waveforms are applied to three types of electrodes to drive a PDP. The three types of electrodes include column electrodes Wj, row electrodes Yk, and a common row electrode X, where the subscripts j, k are natural numbers indicating the sequences of the column electrodes W and the row electrodes Y. The driving principle of the three-electrode surface discharge type ac PDP is identical to that of the aforementioned two-electrode opposite discharge type ac PDP, so it can be applied to the two-electrode opposite discharge type ac PDP without problems. Under the present circumstances, the three-electrode surface discharge type ac PDP is in the mainstream and more suitable for matrix display using ac discharge. For display of a moving image, different static images are displayed every 1/60 second, for example. Here the display period for a single static image is a single frame. To control gradation, a single frame should be divided into a plurality of sub-fields. A single sub-field is the minimum unit of a frame. For 256-level gradation, for example, one frame is divided into eight sub-fields which emit light in the proportions of $2^0:2^1:2^2:2^3:2^4:2^5:2^6:2^7$, respectively. Each sub-field consists of three periods. The first period is a reset period to handle two important matters: (1) to erase and reset wall charge left in the cells after discharge occurs in each sub-field (i.e., erasing reset); and (2) to induce discharge in all the cells at least one time in each frame to supply priming particles for smoothing the address discharge into the panel (i.e., priming reset). The voltage pulse for the erasing reset, which is applied across electrodes, is different from that for the priming reset. That is, the voltage for the erasing reset is suppressed lower than that for the priming reset to suppress an increase in luminance in dark display (i.e., contrast reduction). The voltages for the erasing reset and for the priming reset are about 230 V and 330 V, respectively. While the PDP shown in FIG. 18 is a self-erase type without applying the erase pulse, the PDP in FIG. 19 performs erasing at the time when the voltage pulses $P_{wp}$, $P_{xp}$ changes from its peak value to the baseline for the priming reset.

The second period is an address period, wherein wall charge (voltage) is selectively developed in the matrix of cells. By inducing discharge between orthogonal column and row electrodes Wj, Yk in selected cells, wall charge can be developed in any desired cell. The voltage across electrodes in selected cells is about 230 V and the same in unselected cells is about 170 V.

The third period is a sustain discharge period to repeat discharge. Here the sustain discharge occurs only in the cells selected in the address period. During the sustain discharge period, sustain discharge occurs across row electrode Yk and the common row electrode X. The voltage across the row electrode Yk and the common row electrode X is about 180 V. The intensity of light in cells increases with the number of times discharge occurs.

We will now briefly describe structural advantages of the three-electrode surface discharge type ac PDP. The row electrodes Yk, X are transparent electrodes formed on the inner surface of the front glass substrate. The column electrodes Wj formed on the inner surface of the rear glass substrate are orthogonal to the row electrodes Yk, X when seen through the front glass substrate and the rear glass substrate. In the three-electrode surface discharge type, phosphors are formed only on the rear glass substrate and sustain discharge occurs between the two row electrodes Yk, X on the front glass substrate. This allows the phosphors to be kept from discharge, thus preventing deterioration of the phosphors. Accordingly, the longevity of the PDP is increased. In the two-electrode opposite discharge type, on the other hand, it is difficult to repeat numbers of short-cycle sustain discharges while keeping phosphors therefrom. Therefore, the structure of the three-electrode surface discharge type ac PDP is suitable for color display using light emission from phosphors.

In the conventional display panels, at least one priming reset discharge is necessary in each frame in order to fill all the cells with priming particles to thereby reduce the voltage generated by the address discharge. However, light emission from the priming reset discharge results in contrast degradation.

Further, an extremely high priming reset voltage (e.g., 330 V) is applied across the electrodes at least one time in each frame. This increases stress on the dielectric layer and thus degrades that layer, resulting in deterioration in the reliability of a PDP.

In the conventional display panels, the address operation cannot be done without discharge. To start discharge, an address time of about 3 μsec is necessary for each cell because of discharge delay of about 1 μsec. For a 128- by 128 cell matrix of ac discharge type display panel which is capable of controlling 256-level gradation, for example, the necessary address time is given by 3 μsec×128 lines×8 sub-fields, i.e., 3.072 msec. When a single frame is 1/60 second and the maximum number of light emissions in a single frame is 8192, the sustain frequency is given by 4096 sustain cycles÷$(1\div60-3.072\times10^{-3})$, i.e., 302 kHz. If the address time can be eliminated, the sustain frequency becomes 4096 sustain cycles×60, i.e., 246 kHz. Since a desirable sustain frequency for sustaining discharge and generating the wall voltage with certainty is considered to be 250 kHz (sustain pulse width of over 2 μsec), it is apparent that the above high-intensity display (8192 light emissions) is impossible when the write (address) time is 3 μsec. For high-intensity display, thus, the write time must be shorten.

The conventional display panels require a voltage of about 230 V to induce address discharge. To generate that address voltage, an integrated circuit having a plurality of output pins for both row and column electrodes is used. This integrated circuit is sensitive to a large current since its allowable current value is low to increase the level of integration. Although the address discharge rarely causes a large current flow, in cases where large charge is abnormally accumulated on the barrier ribs of discharge cells or the surface of the dielectric layer, the application of voltage as large as 230 V in the address operation induces, along with internal charge, high-voltage discharge in the cells. This results in a large current. Large current may cause a malfunction in the part of the integrated circuit which are relevant to bits corresponding to the row and column electrodes. Such a malfunction will result in an inline defect on display for matrix display and a dot defect on display for static-driven display. In this fashion, address discharge may cause an abnormal current flow resulting in an undesirable display.

Furthermore, the conventional display panels ensure the driving margin by erasing the wall charge without fail in each sub-field. However, it is difficult to completely erase the wall charge in all the cells by erase discharge. Some positive or negative wall voltage is thus left even after the erase discharge. If the wall charge in all the cells can completely be erased, the range of the sustain voltage Vs becomes as follows: the minimum discharge sustain voltage (minimum voltage to maintain sustain discharge)<Vs<230 V (address voltage). This range is narrowed in proportion to the amount of remaining wall voltage after the erase discharge. This insufficient erasing of the wall voltage induces error discharge, thereby degrading image quality.

SUMMARY OF THE INVENTION

A first aspect of the present invention is directed to a display device comprising a display panel using ac discharge and a driving circuit. The display panel includes a discharge cell provided with a first electrode and a second electrode covered with a dielectric, and causes light emission from the discharge cell by inducing ac gas discharge by the first and second electrodes. The driving circuit performs the steps of: (a) causing a discharge emission in the discharge cell by applying a sustain voltage to the first electrode by the use of a wall voltage generated in the discharge cell; and (b) preventing the discharge emission from occurring in the discharge cell without erasing the wall voltage, even if the sustain voltage is applied to the first electrode.

According to a second aspect of the present invention, in the display device of the first aspect, the driving circuit further performs the step of: (c) generating the wall voltage by generating a voltage higher than a firing voltage by the use of the first and second electrodes, the step (c) being performed once in a predetermined number of frames of the steps (a) and (b).

According to a third aspect of the present invention, in the step (c) of the second aspect, the wall voltage is generated only by a single voltage pulse which changes gently from its peak value to the baseline.

According to a fourth aspect of the present invention, in the step (c) of the second aspect, the wall voltage is generated by a first voltage pulse having a higher voltage than the firing voltage, and a second bipolar voltage pulse which is applied following the first voltage pulse, the second bipolar voltage pulse having an amplitude lower than the first voltage pulse.

According to a fifth aspect of the present invention, in the display device of either of the first through fourth aspects, the steps (a) and (b) of are switched by shifting a baseline of a bipolar voltage pulse which is applied across the first and second electrodes.

According to a sixth aspect of the present invention, the step (b) of the fifth aspect lasts for a period of time about an integral multiple of a cycle of the bipolar voltage pulse.

According to a seventh aspect of the present invention, the step (b) of the sixth aspect comprises the step of: starting a condition where the baseline is shifted by a predetermined value between the end of a voltage pulse of one polarity and the beginning of a voltage pulse of the opposite polarity, and after the period of time, terminating the condition between the end of a voltage pulse of one polarity and the beginning of a voltage pulse of the opposite polarity, the voltage pulse of one polarity and the voltage pulse of the opposite polarity constituting the bipolar voltage pulse.

According to an eighth aspect of the present invention, the step (b) of the sixth aspect includes the steps of (b-1) varying the baseline so that a baseline of a voltage pulse of one polarity takes a first value and a baseline of a voltage pulse of the opposite polarity takes a second value, the voltage pulse of one polarity and the voltage pulse of the opposite polarity constituting the bipolar voltage pulse, the first and second values being set to minimize a difference between the maximum value and the minimum value of the bipolar voltage pulse.

According to a ninth aspect of the present invention, the step (b-1) of the eighth aspect is performed between the end of a voltage pulse of one polarity and the beginning of a voltage pulse of the opposite polarity, the voltage pulse of one polarity and the voltage pulse of the opposite polarity constituting the bipolar voltage pulse.

According to a tenth aspect of the present invention, in the step (b) of either of the fifth through ninth aspects, the baseline is shifted by varying a voltage applied to either of the first and second electrodes.

According to an eleventh aspect of the present invention, in the step (b) of either of the fifth through ninth aspects, the baseline is shifted by varying both voltages applied to the first and second electrodes.

According to a twelfth aspect of the present invention, in the display device of the eleventh aspect, a voltage applied to the second electrode varies in the step (b), and a voltage applied to the first electrode is shifted by the same amount in the steps (a) and (b).

According to a thirteenth aspect of the present invention, in the display device of the twelfth aspect, the driving circuit further performs the step of: resetting a baseline of the amplitude of the wall voltage to 0 V.

According to a fourteenth aspect of the present invention, in the display device of either of the twelfth and thirteenth aspects, each of the steps (a) and (b) comprises the step of: applying the sustain voltage to the first electrode which is provided in common to plurality of discharge cells.

A fifteenth aspect of the present invention is directed to a method of driving a display panel using ac discharge. The display panel includes a discharge cell provided with a first electrode and a second electrode covered with a dielectric, and causes light emission from the discharge cell by inducing ac gas discharge by the first and second electrodes. The method comprises the steps of: (a) causing a discharge emission in the discharge cell by applying a sustain voltage to the first electrode by the use of a wall voltage generated in the discharge cell; and (b) preventing the discharge emission from occurring in the discharge cell without erasing the wall voltage, even if the sustain voltage is applied to the first electrode.

In the display device of the first aspect, since both the steps (a) and (b) hold the wall voltage, light emission/no light emission from the discharge cells can be controlled with the wall voltage always held in the discharge cells. This avoids the necessity of the erasing reset discharge for erasing the wall voltage and the priming reset discharge for supplying priming particles to the discharge cells, which are necessary several to several tens of times in each frame in conventional display devices. Further, discharge/light emission which is irrelevant to display does not occur during the display period. This considerably reduces luminance in dark display, thus improving contrast.

Since the constant amount of wall voltage is held during the display period (occupying most of the time) except the wall-voltage generation period, low-reliability operation such as erasing reset becomes unnecessary. This almost prevents the occurrence of abnormal charge, thus reducing dot defects on display due to a malfunction in the circuit elements caused by the address voltage.

Further, the wall voltage to be used is determined by stable elements which are not susceptible to variations caused by the positions of the discharge cells (e.g., dielectric thickness, sustain voltage, firing voltage determined by discharge gap and gas). This stabilizes the driving margin.

In the display device of the second aspect, the wall voltage is generated once in a plurality of frames of the steps (a), (b). The device thus requires a smaller number of high-voltage applications for the generation of the wall voltage than conventional display devices wherein voltage is applied once in each frame. This decreases the probability of deterioration in the insulating property of the dielectric due to high-voltage application and suppresses the occurrence of dot/line defects on display, which improves reliability of the device.

In the display device of the third aspect, since the voltage pulse changes gently from its peak value to the baseline, discharge hardly occurs at the time of that change. This stabilizes the generation of the wall voltage.

In the display device of the fourth aspect, the wall voltage is generated by the second bipolar voltage pulse which is smaller in amplitude than the first voltage pulse. Thus, the same amount of wall voltage as in the step (a) can be generated.

In the display device of the fifth aspect, the steps (a) and (b) are switched by shifting the baseline of the bipolar voltage pulse which is applied across the first and second electrodes. This device can thus save the address time (period), while conventional display devices require the address time of about 3 $\mu$sec. This allows a sufficient number of pulses to be provided in each frame, thus increasing luminance of the ac discharge type display panel to be driven.

In the display device of the sixth aspect, the step (b) lasts for a period of time about an integral multiple of the cycle of the bipolar voltage pulse. This can be achieved by a simple circuit, thus simplifying the structure of the panel to be driven.

In the display device of the seventh aspect, the baseline is shifted when the bipolar voltage pulse is not applied. Accordingly, a stable discharge emission is obtained.

In the display device of the eighth aspect, the value by which the baseline is shifted varies according to the polarity of the voltage pulse. This makes it easy to reduce the amplitude of the bipolar voltage pulse, thus improving the function of preventing the occurrence of an error discharge emission in the step (b). For example, the driving pulse of the individual electrodes for no light emission is set so that the address voltage is applied only while the sustain voltage of positive polarity is applied. At this time, the address voltage should be larger than its lower limit determined by the sustain voltage, without the upper limit. The sustain voltage should also be larger than its minimum value without the upper limit. In this fashion, the display panel can be driven with a considerably wide driving margin.

In the display device of the ninth aspect, the baseline is shifted when the bipolar voltage pulse is not applied. Accordingly, stable discharge emission is obtained.

In the display device of the tenth aspect, the baseline can be shifted by the use of only either of the first and second electrodes. This simplifies the structure of the device to be driven.

In the display device of the eleventh aspect, the baseline is shifted by the use of both the first and second electrodes. This reduces variations in the voltage applied to each electrode, thus simplifying the structure of the device to be driven.

In the display device of the twelfth aspect, the withstand voltage at the second electrode can be reduced since there is no variation in the voltage at the first electrode. For example, the withstand voltage of the device to be driven can be reduced by reducing variations in the voltage at the second electrode which includes a large number of pins.

In the display device of the thirteenth aspect, the baseline of the amplitude of the wall voltage is reset to 0 V. This stabilizes the operation of the step (b).

In the display device of the fourteenth aspect, the first electrode is common to a plurality of discharge cells. This allows simple handling of the display panel to be driven.

The driving method of the fifteenth aspect achieves the same effect as in the first aspect.

An object of the present invention is to avoid discharge and light emission, which are irrelevant to display, during the display period by preventing the erasing reset discharge for erasing the wall voltage and the priming reset discharge for supplying priming particles into discharge cells from being performed several to several tens of times in each frame. It is also an object of the present invention to improve the instability of the erasing reset discharge.

These and other objects, features, aspects and advantages of the present invention will become more apparent from the following detailed description of the present invention when taken in conjunction with the accompanying drawings.

DESCRIPTION OF THE PREFERRED EMBODIMENTS

First Preferred Embodiment

Figure 1:
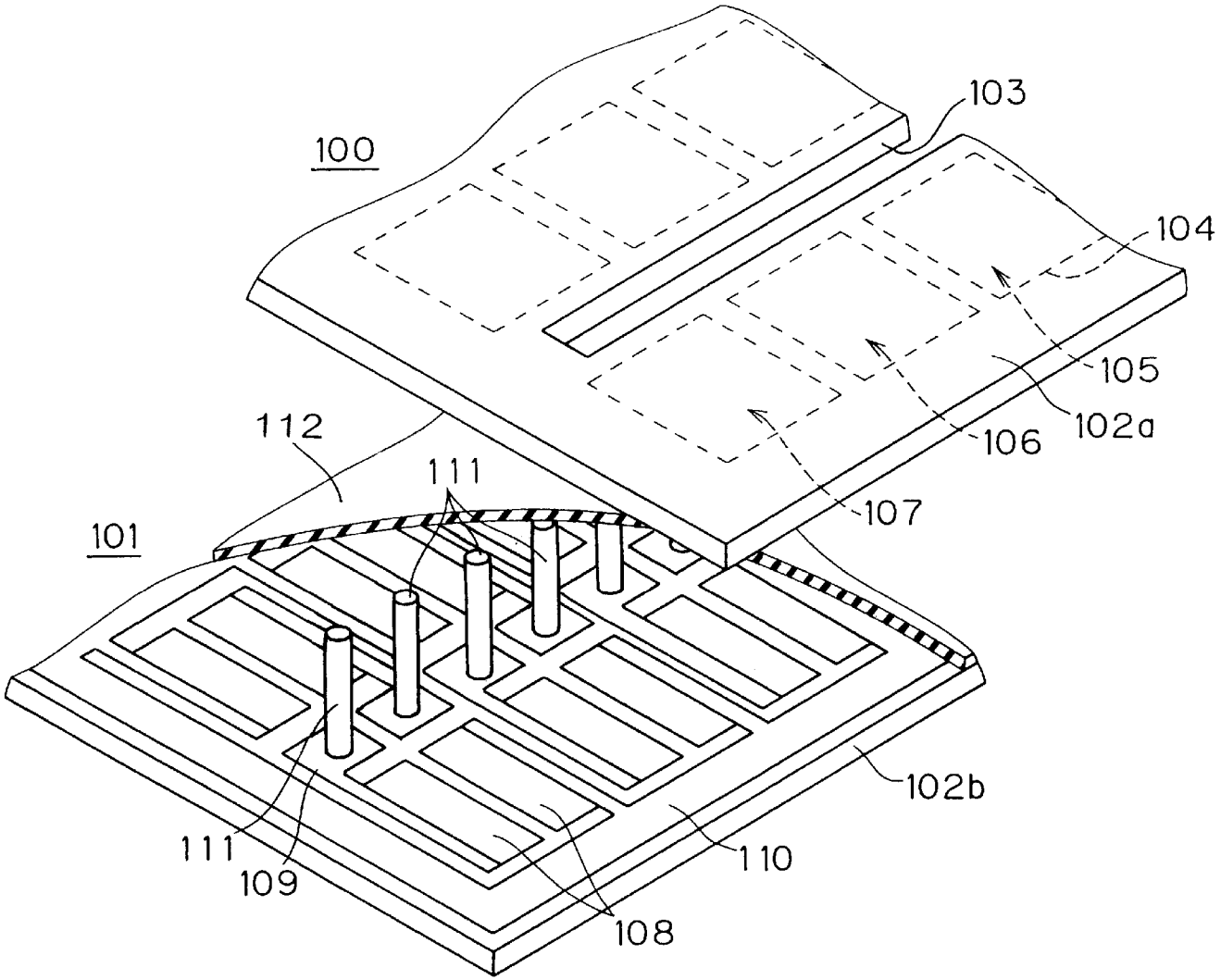
FIG. 1 is a an exploded perspective view showing the structure of a display panel using ac discharge according to the present invention.
Figure 2:
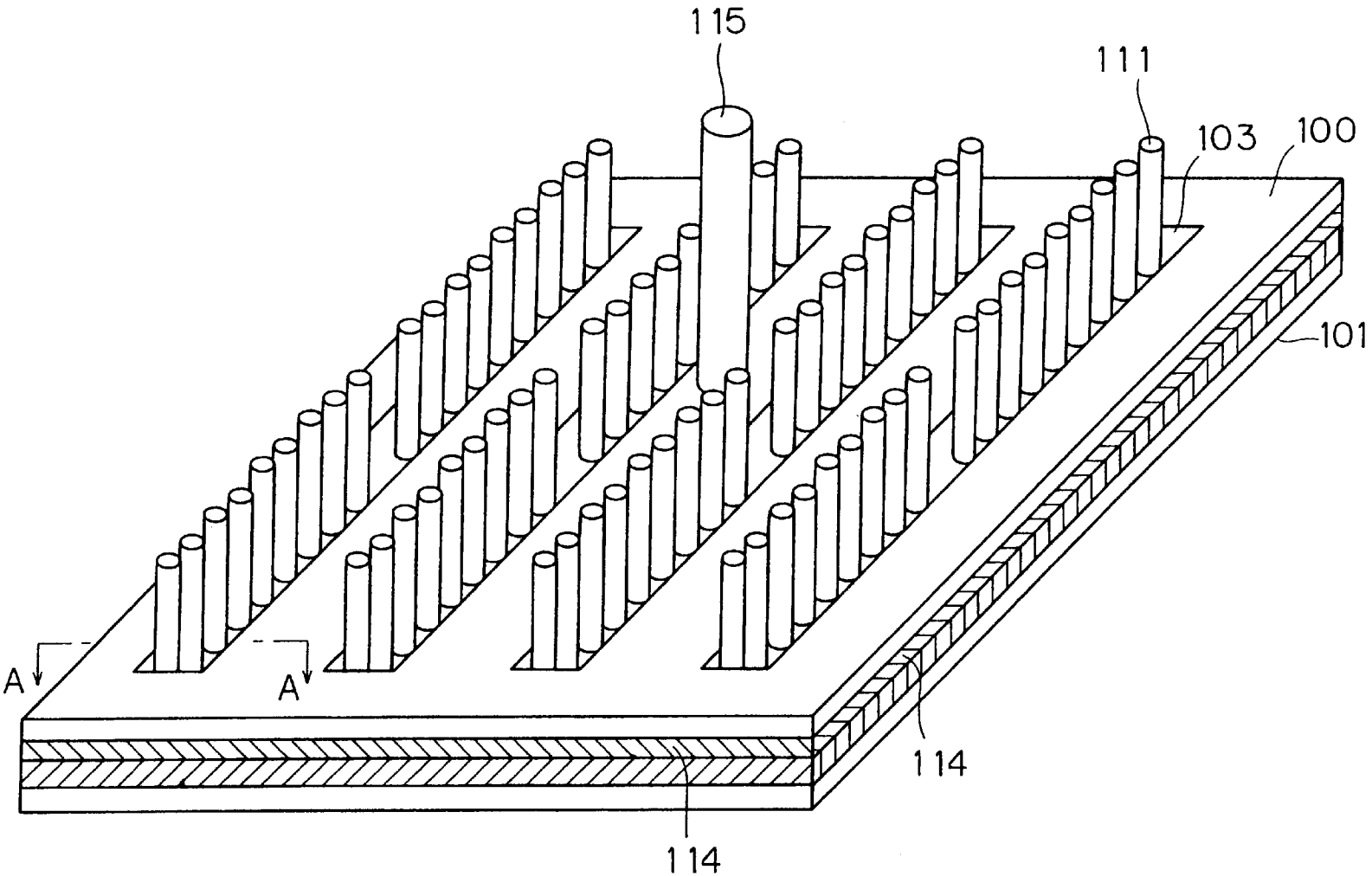
FIG. 2 is a perspective view showing the display panel of FIG. 1 in its assembled condition.
Figure 3:
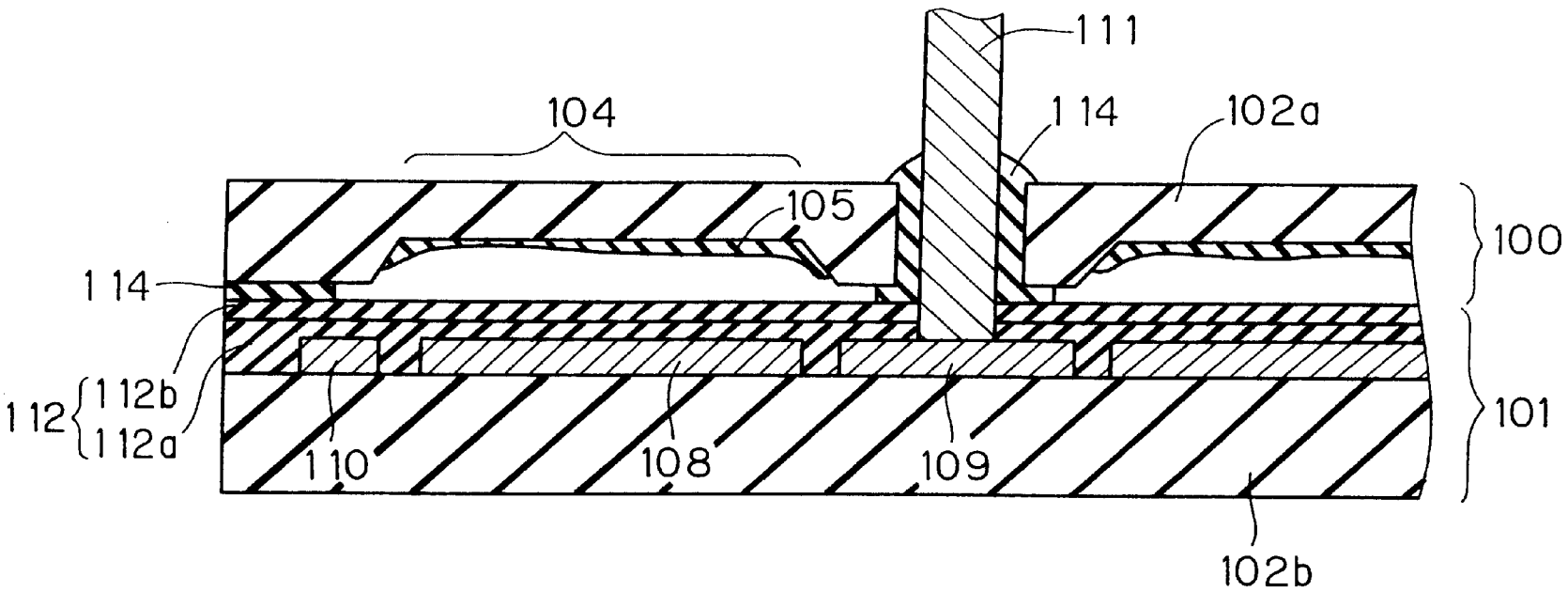
FIG. 3 is a cross-sectional view taken along the line A—A of FIG. 2.

A display device according to a first preferred embodiment comprises a display panel using ac discharge and a driving circuit. The following is a description of how to drive the display panel of the first preferred embodiment. First, the structure of the display panel is described. FIG. 1 is an exploded perspective view showing the structure of a display panel to be driven. FIG. 2 is a perspective view showing an overview of the display panel of FIG. 1 in its assembled condition. FIG. 3 is a cross-sectional view taken along the line A—A in FIG. 2. As shown in FIGS. 1 to 3, the display panel using ac discharge comprises a rear substrate 100 and a front substrate 101. The rear substrate 100 is formed of a glass substrate 102*a* which is provided with a through hole 103 for pulling electrode pins, and recesses formed in the inner surface for space. Each of the recesses corresponds to a discharge cell 104. The inner surface of each recess is coated with either one of a blue phosphor 105, a green phosphor 106, and a red phosphor 107. Three adjacent discharge cells or recesses coated with the red, blue, and green phosphors, respectively, forms a single pixel.

The front substrate 101 is formed of a glass substrate 102*b*. In the position corresponding to each discharge cell 104 on the inner surface of the glass substrate 102*b*, there are formed a pair of transparent electrodes (first and second electrodes) 108 of ITO or tin oxide, for example. A common electrode 110 is connected to one of the pair of transparent electrodes 108, and an individual electrode 109 is connected to the other of the pair of transparent electrodes 108. The number of individual electrodes 109 is equal to the number of discharge cells 104. The common electrode 110 includes mother electrodes or bus electrodes each connected to one of a pair of transparent electrodes 108, and in-panel wiring connected to the mother electrodes. The individual electrodes 109 and the common electrode 110 are connected to external devices by electrode pins 111. Each of them has a pad to fix a corresponding electrode pin 111. These pads are provided in positions corresponding to dark space between pixels. The transparent electrodes 108, the individual electrodes 109, and the common electrode 110 are covered with a layer 112 consisting of a dielectric layer 112*a* and a protective layer 112*b*. In this layer 112, the dielectric layer 112*a* is on the side of the glass substrate 102*b* and the protective film 112*b* of magnesium oxide, for example, is on the side of the rear substrate 100.

The front substrate 100 and the rear substrate 101 are assembled as shown in FIG. 3 so that the inner surface with the phosphors 105 (to 107) is superposed over the inner surface with the transparent electrodes 108 and the individual/common electrodes 109, 110. The electrode pins 111 are horizontally aligned with the through holes 103. A sealing layer 114 is provided to fill the peripheries of the front and rear substrates 100, 101 and the through holes 103 other than the parts occupied by the electrode pins 111. This forms a glass vessel. To exhaust air from the vessel and fill discharge gas, an exhaust glass tube 115 is provided in the middle of the panel.

A single panel consists of 8 by 8, 16 by 16, or 32 by 32 pixels, for example. The pixel pitch is between 5 and 30 mm. Each electrode pin 111 is connected to a printed circuit board (not shown). Driving circuits on this printed circuit board apply voltages to the individual electrodes 109 and the common electrode 110. These driving circuits control discharge to provide an image on the display panel. By tiling a plurality of panels vertically and horizontally, a large display panel is obtained.

In the display panel using ac discharge in FIG. 1, the transparent electrodes 108 as discharge electrodes and the phosphors 105 to 107 are separately provided on the front substrate 100 and on the rear substrate 101, respectively. This structure embodies the merits of the three-electrode surface discharge type ac PDP. By keeping the phosphors 105 to 107 from discharge, deterioration in the phosphors is considerably reduced and thus the longevity of the display device is increased. The display panel itself is, however, a two-electrode surface discharge type ac PDP.

For display, electrodes which supply electric power to the respective discharge cells must be drawn to the outside of the display panel. Since it is difficult to form the row and column electrodes on the same plane (although it might be possible with a hierarchical structure), the display panel of FIG. 1 uses the electrode pins 111 of the individual electrodes 109 corresponding to respective cells and the electrode pin 111 of the common electrode 110 to establish connections between the electrodes in the display panel and external elements. Of course, only the electrode pins necessary for matrix driving can be drawn from the row and column electrodes as in the PDP, which requires a smaller number of pins. For an 8- by 8-pixel matrix, for example, the number of pins required for the matrix driving is 3 (RGB)×8 (column)+8 (row)=32, while the number of pins with the structure of FIG. 1 is 8×8 (individual electrodes)+1 (common electrode)=193. The matrix driving, however, has similar problems as in the conventional ac PDP, e.g., contrast degradation due to reset discharge, pixel defects on display due to deterioration in the insulating property of the dielectric on the panel, line defects on display, low intensity due to the ratio of the address time to each frame, malfunctions in a driving IC due to high address voltage, and reduction in the driving margin due to wall charge left after erasing reset.

Figure 4:
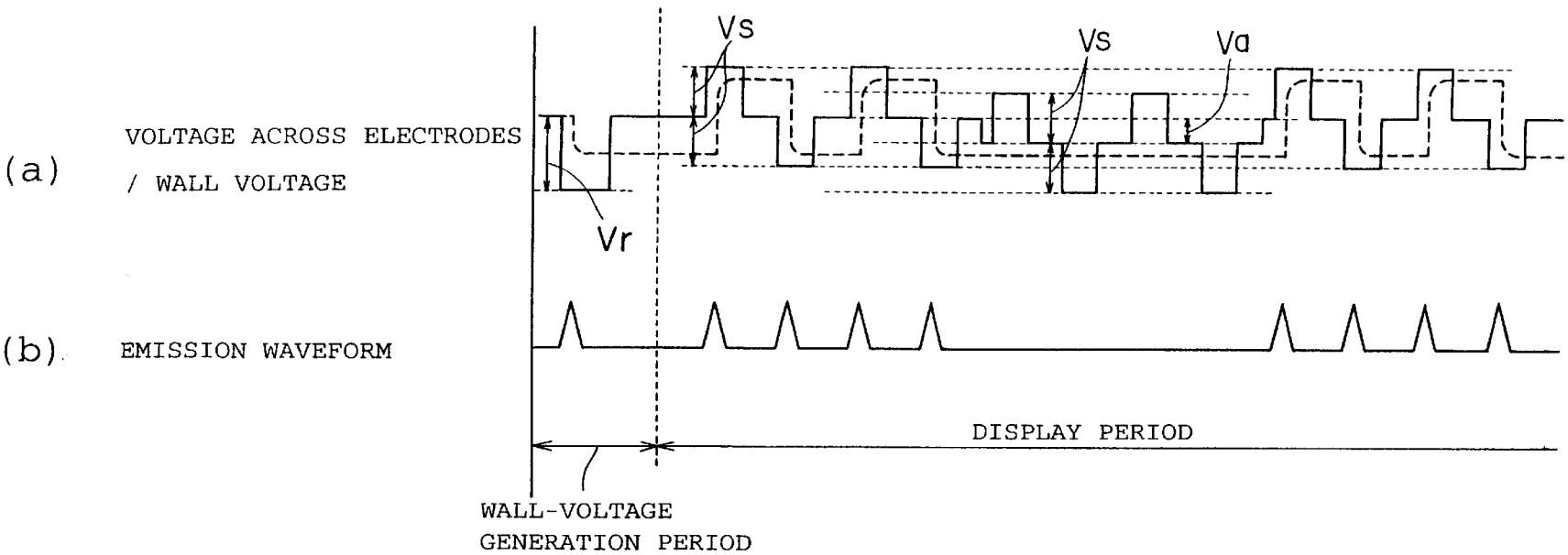
FIG. 4 is a timing chart to explain how to drive a display panel using ac discharge according to the first preferred embodiment.

In order to avoid such problems and to obtain a high-quality reliable display device using ac discharge, the device of FIG. 1 is configured to control discharge through the individual electrodes 109 corresponding to the respective cells, and the common electrode 110 common to all the cells. FIG. 4 shows a driving principle of the display panel of FIG. 1 according to the first preferred embodiment, wherein (a) shows the voltage across the individual electrodes 109 and the common electrode 110 (solid line) and the wall voltage (broken line), and (b) shows the waveform of light emission.

The driving principle of the display panel of the first preferred embodiment differs considerably from that of the ac discharge type PDP. As previously described, the ac discharge type PDP displays an image through three processes: the erasing reset period (including several times of priming reset in each frame), the address (write) period, the sustain (display) period. In the driving principle of the first preferred embodiment, on the other hand, display is achieved through the process of generating a wall voltage, which is performed about once in every several tens or hundreds of frames, and the process of turning on/off a discharge switch. The resultant wall charge is kept in the cells according to this principle, while the ac discharge type PDP erases wall charge for each sub-field.

The following is a detailed description of the driving principle of the display panel of the first preferred embodiment. A voltage Vr which is large enough to induce discharge throughout the individual electrodes 109 and the common electrode 110 is applied once in every several tens or hundreds of frames. The application of the wall-voltage generation voltage Vr develops a wall voltage across the display (in all the cells). The purpose of this wall-voltage generation period is to generate a wall voltage in the cells. Since the wall voltage is stored in the display device, the wall-voltage generation period needs to be provided only once when the display device is switched on. However, in case of accidental disappearance of wall voltage which may occur in some cells during operation due to an external factor, the wall-voltage generation period is provided once every second.

The wall voltage generated in the wall-voltage generation period and the sustain voltage Vs applied from the outside across the transparent electrodes 108 repeatedly induce discharge, which causes light emissions the identical number of times discharge occurs. In the address operation, the voltage from the outside is reduced to such an extent that the sustain discharge does not occur (i.e., a sum of the wall voltage and the voltage in the discharge space falls short of the firing voltage). This voltage reduction stops discharge and light emission. Just before the sustain voltage of positive polarity is applied across the electrodes, the baseline of the sustain voltage is shifted by a predetermined value toward the negative side. This voltage reduced to stop discharge is referred to as the "address voltage Va". The voltage at this time is $Vgf>Vw+Vs-Va$, where the firing voltage in the discharge space (across discharge gaps) is Vgf and the wall voltage is Vw. That is, the firing voltage Vgf is larger than a value obtained by subtracting the address voltage Va from the sum of the wall voltage Vw and the sustain voltage Vs. After discharge is stopped, the sustain voltage of negative polarity is applied across the electrodes in the latter half of the sustain cycle. At this time, the address voltage Va is applied from the outside to encourage discharge but the wall voltage is applied in the opposite direction, which prevents the occurrence of discharge. The voltage at this time is $Vgf>-Vw+Vs+Va$. That is, the firing voltage Vgf is larger than the value obtained by adding the address voltage Va to a difference between the wall voltage Vw and the sustain voltage Vs. Accordingly, no discharge or light emission occurs during the application of the address voltage Va. When the address voltage Va is removed from across the electrodes and the baseline of the sustain voltage is returned to the original position, discharge occurs again from the sustain voltage Vs and the wall voltage Vw since the wall voltage Vw is kept in the discharge space. In this fashion, the period of discharge emission and the period of no discharge emission can be switched by varying the address voltage Va in cycles about an integral multiple of the cycle of the bipolar voltage pulse (sustain pulse). A switching circuit for such an operation has a simple configuration, so the structure of a panel to be driven is simplified. To increase the stability of discharge emissions, the baseline shifting is preferably performed while the bipolar voltage pulse is not applied.

For gradational image display, the length of time light emission occurs from pixels in each frame is controlled by the application time of the address voltage Va. That is, the length of light emission from pixels is shortened to reduce brightness and lengthened to increase brightness. In order to stop light emission from pixels, the address voltage Va should be applied across each individual electrode 109 and the common electrode 110, using the same individual electrode. At this time, the timing should be adjusted to the application of the sustain voltage.

As above described, the display device using the individual electrodes can resolve the problems in conventional ac discharge type display devices. First of all, the problem of contrast degradation due to several light emissions in each frame from the priming reset discharge can be resolved. More specifically, since discharge or light emission occurs during the wall-voltage generation period, which is provided only once in every several tens or hundreds of frames, luminance in black display becomes considerably low.

Further, while the conventional ac discharge type display device needs to apply a voltage of as high as 330 V across the electrodes several times in each frame, the display device of the first referred embodiment requires only one application of the voltage in several tens or hundreds of frames. This prevents deterioration in the insulating property of the dielectric layer 112 due to frequent applications of high voltage, thus considerably decreasing the probability of dot and line defects on display.

The conventional ac discharge type display device needs the address period and takes some time for that operation. The display device of the first preferred embodiment, on the other hand, requires little address time. This makes it possible to provide a sufficient number of pulses (sustain pulses) in each frame, thereby allowing a high-intensity ac discharge type display device.

In the address operation of the conventional ac discharge type display device to generate a wall voltage for cell selection, the address voltage of as high as 230 V is applied to induce discharge in the discharge cells 104 where sustain discharge is to be induced. All the wall charge is usually erased during the reset period, but in rare cases, some discharge cells 104 may enter the address period while containing extremely large wall voltage left on their barrier ribs. In such abnormal discharge cells 104, the voltage of as high as 230 V and the large wall voltage may cause a large current flow, which results in a malfunction in the circuit element. In the display device of the first preferred embodiment, on the other hand, the address voltage Va to be applied for the address operation is about 100 V; thus, no discharge occurs during the operation. That is, the display device of the first preferred embodiment seldom causes dot defects on display due to a malfunction in the circuit element caused by the address voltage.

Figure 5:
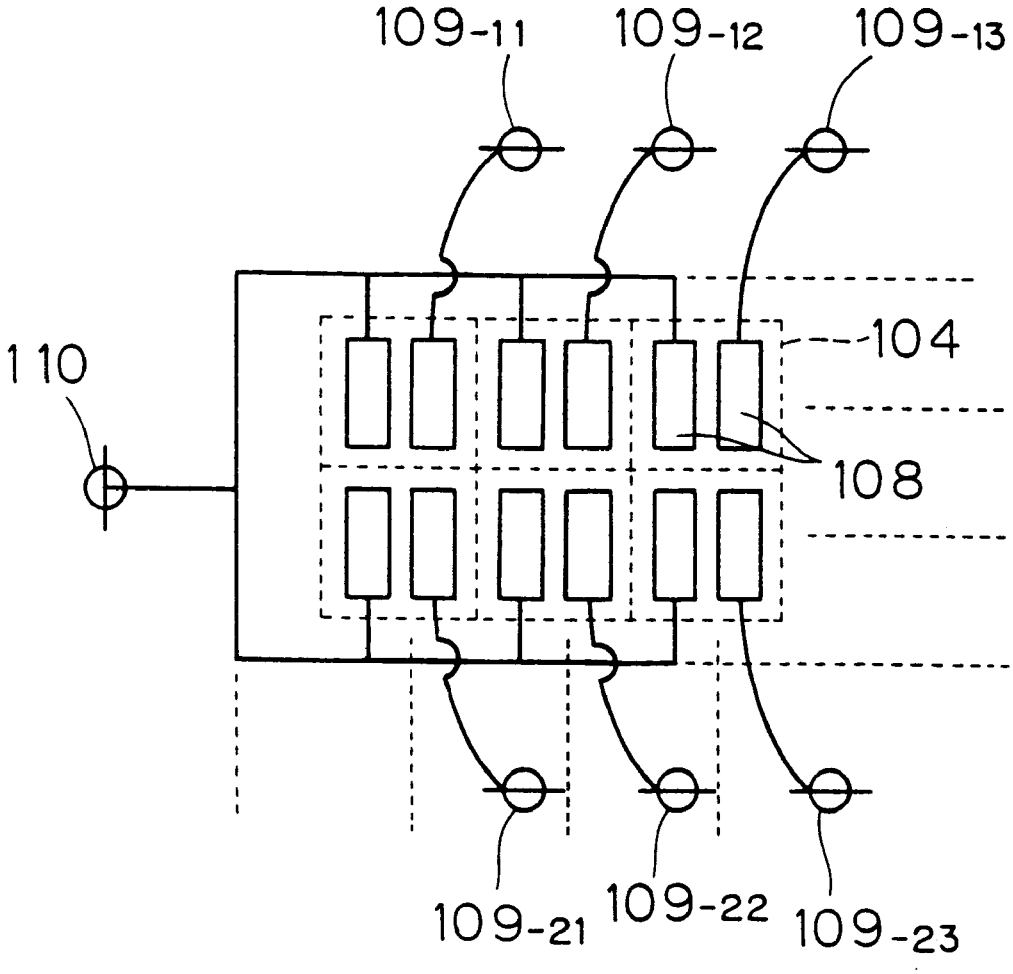
FIG. 5 shows the connections between surface discharge electrodes, i.e., a common electrode and individual electrodes

The above description has presented the driving principle and the effects of the display device according to the first preferred embodiment of the present invention. Next, we will describe the voltage waveforms across the individual electrodes and the common electrode, and the circuit configuration for generating those voltage waveforms. FIG. 5 shows connections between the individual electrodes and the common electrode, which form a surface discharge electrode. In each discharge cell 104, one transparent electrode is connected in common to an external common-electrode driving circuit by the common electrode 110, and the other transparent electrode is connected by an individual electrode (109-$_{11}$ to 109-$_{23}$) to a corresponding one of a plurality of individual-electrode driving circuits. The individual electrodes are identical in structure and some (i.e., 109-$_{14}$, 109-$_{24}$, and later) are not illustrated in FIG. 5.

Figure 6:
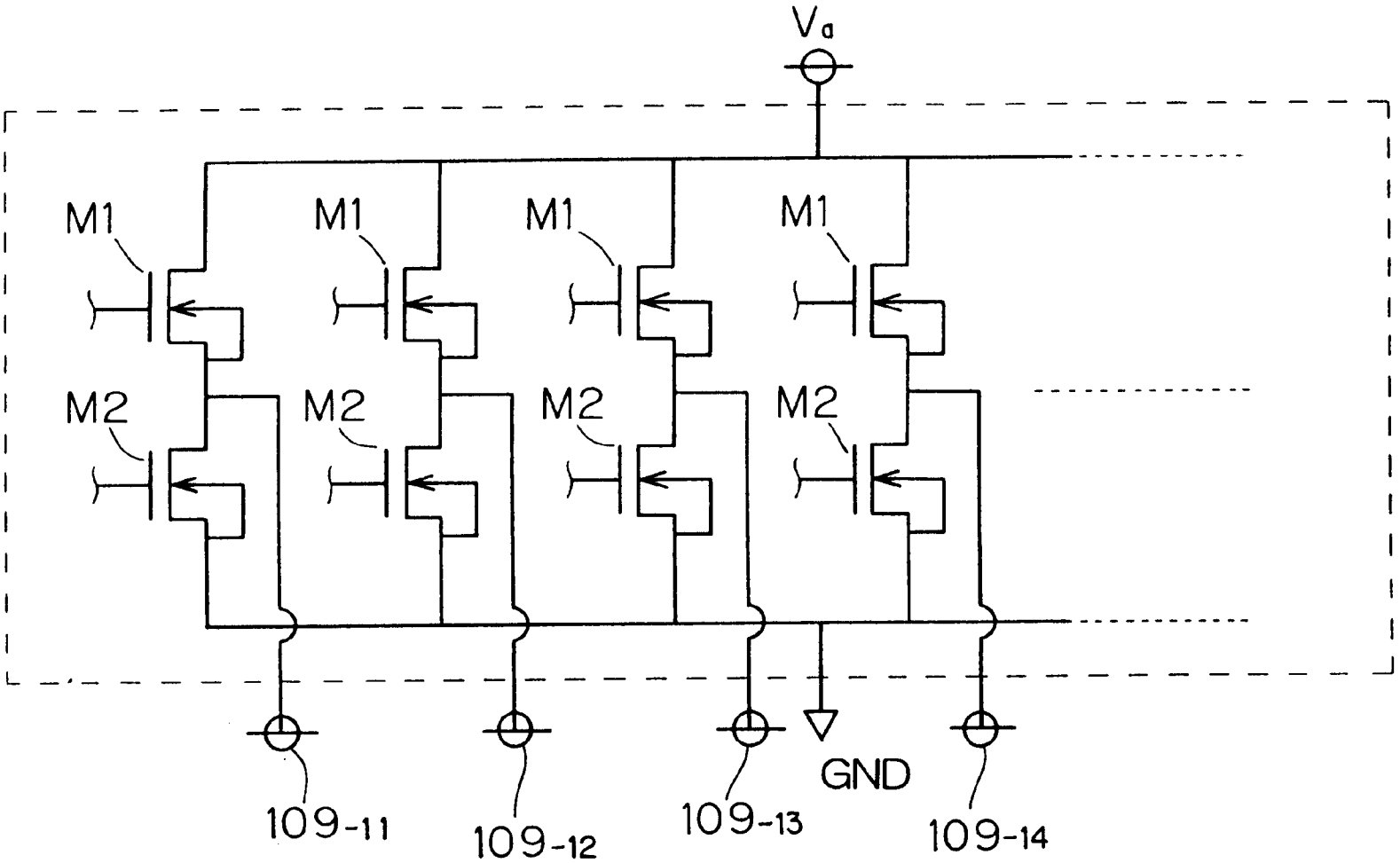
FIG. 6 is a circuit diagram of an individual-electrode driving circuit.

FIG. 6 is a circuit diagram of individual-electrode driving circuits. The individual-electrode driving circuits are integrated because of a large number of electrode pins of the individual electrodes 109. As shown, each individual-electrode driving circuit is composed of two MOS transistors M1, M2 connected in series between the junction where the address voltage Va is applied and the junction where the ground voltage is applied. The junction of the two MOS transistors M1, M2 is the output terminal. Controlled by an external input signal applied to the control electrode, either of the voltages Va and GND is outputted to the output terminal. The external input signal is a serial signal which is generated by serial/parallel data conversion in a sample hold circuit in the IC. The sample hold circuit and the external input signal are simple in structure and conventionally well-known, so they are not shown in the drawing.

Figure 7:
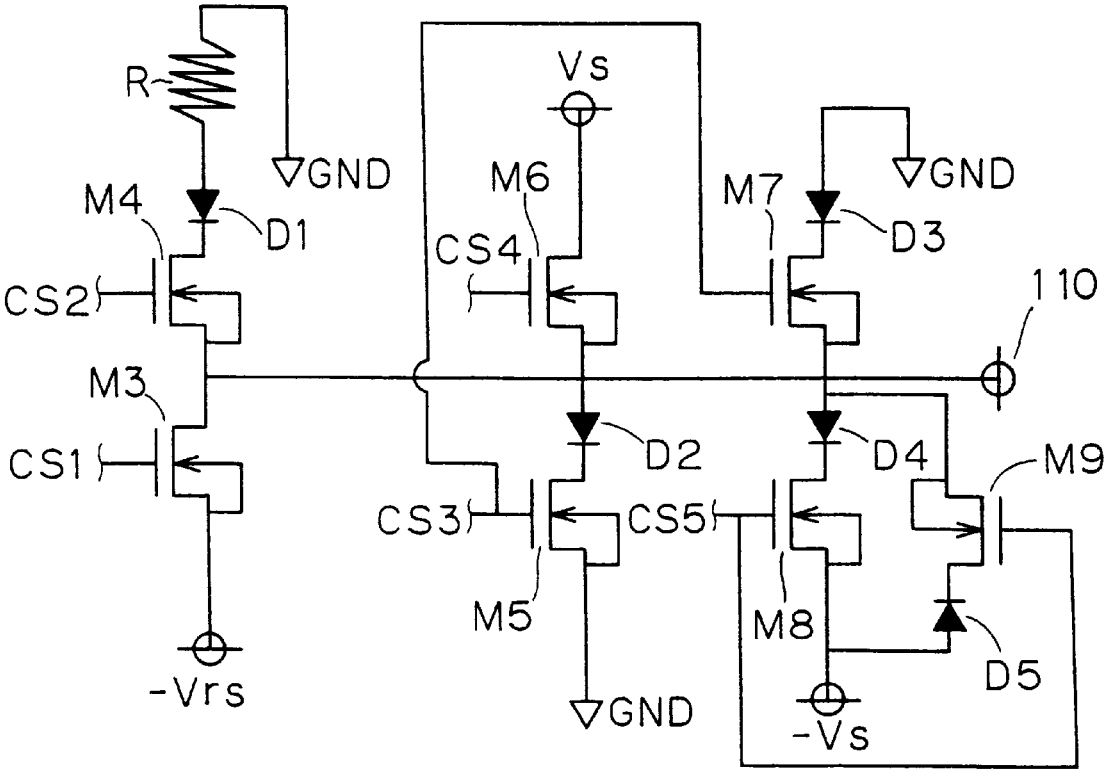
FIG. 7 is a circuit diagram of a common-electrode driving circuit.

FIG. 7 is a circuit diagram of the common-electrode driving circuit. The common-electrode driving circuit is composed of seven NMOS transistors M3 to M9. It can output four levels of voltages: the ground voltage GND, the wall-voltage generation voltage (−Vrs), and the sustain voltages (−Vs, Vs).

The connections between elements in the common-electrode driving circuit are now described. The NMOS transistor M3 has a gate for receiving a control signal CS1, a source to which the wall-voltage generation voltage (−Vrs) is applied, and a drain connected to the common electrode 110. The NMOS transistor M4 has a drain, a gate for receiving a control signal CS2, and a source connected to the common electrode 110. A diode D1 has an anode and a cathode connected to the drain of the NMOS transistor M4. A resistance R has one end connected to the anode of the diode D1 and the other end to which the ground voltage GND is applied. The NMOS transistor M5 has a drain, a gate for receiving a control signal CS3, and a source to which the ground voltage GND is applied. A diode D2 has a cathode connected to the drain of the NMOS transistor M5 and an anode connected to the common electrode 110. The NMOS transistor M6 has a source connected to the common electrode 110, a drain to which the sustain voltage Vs is applied, and a gate for receiving a control signal CS4. The NMOS transistor M7 has a drain, a gate for receiving the control signal CS3, and a source connected to the common electrode 110. A diode D3 has an anode to which the ground voltage GND is applied and a cathode connected to the drain of the NMOS transistor M7. The NMOS transistor M8 has a drain, a gate for receiving a control signal CS5, and a source to which the sustain voltage (−Vs) is applied. A diode D4 has an anode connected to the common electrode 110 and a cathode connected to the drain of the NMOS transistor M8. The NMOS transistor M9 has a drain, a source connected to the common electrode 110, and a gate for receiving the control signal CS5. A diode D5 has an anode to which the sustain voltage (−Vs) is applied and a cathode connected to the source of the NMOS transistor 9.

The common-electrode driving circuit in FIG. 7 is characterized in that, on the drain side of the switch (NMOS transistor M4) by which the wall-voltage generation voltage (−Vrs) rises to the ground voltage GND, the resistance R is provided so that a pulse changes gently from its peak value to the baseline (i.e., pulse is round). The wall-voltage generation voltage −Vrs is a voltage applied to generate a wall voltage to be set in all cells, in the early stage, so it is high in value. A high-voltage pulse for applying the wall-voltage generation voltage (−Vrs), however, may erase the wall voltage since discharge is induced not only at its falling edge but also at its rising edge. To prevent such discharge at its rising edge, the resistance R allows the pulse to change gently from its peak value to the baseline.

Figure 8:
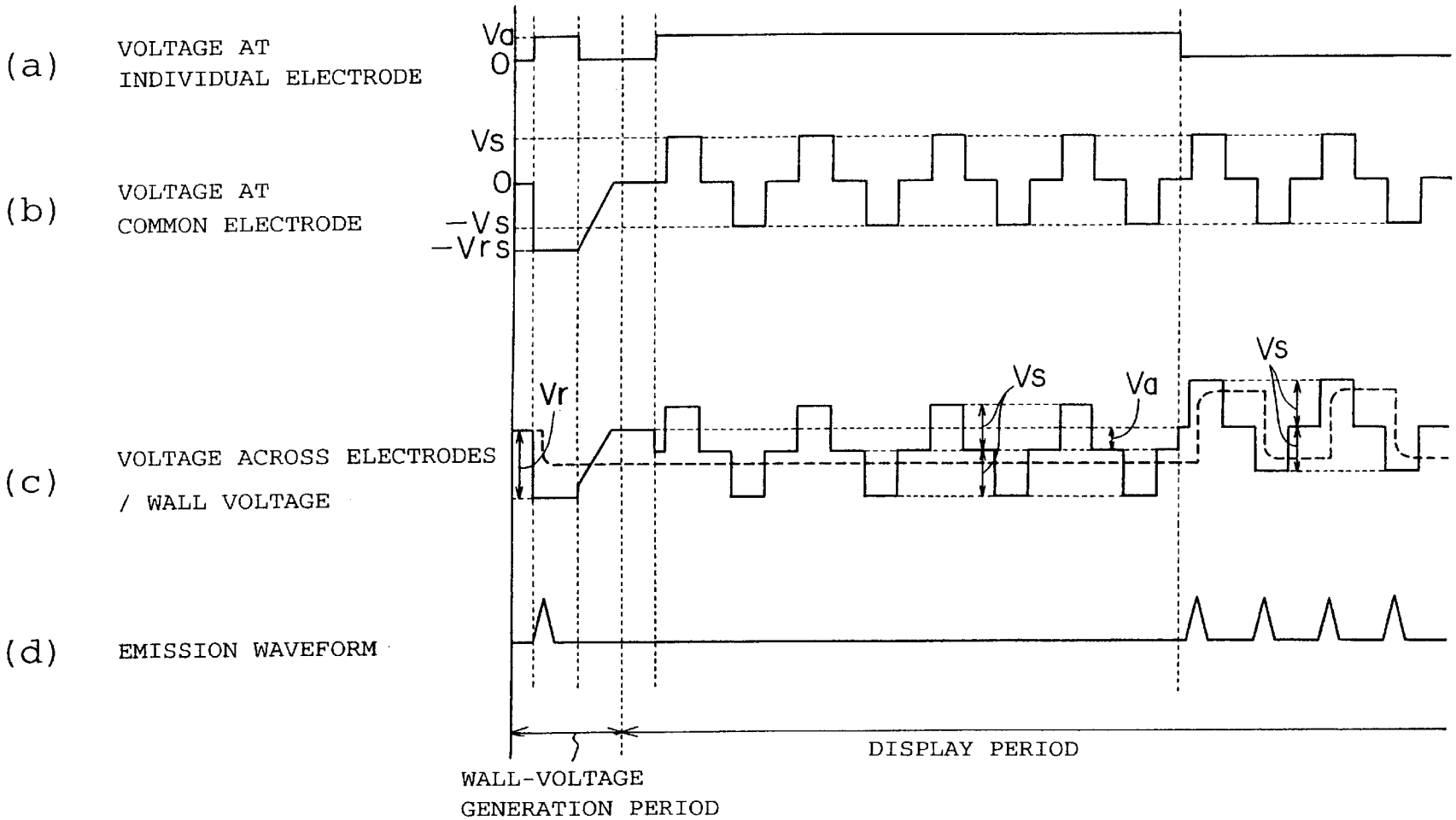
FIG. 8 is a timing chart showing the voltage waveforms of the common electrode and the individual electrodes for generating the voltage across electrodes and the wall voltage of FIG. 4.

FIG. 8 is a timing chart to explain the voltage waveforms of the common voltage and the individual electrodes for obtaining the voltage across the electrodes and the wall voltage in FIG. 4. In FIG. 8, (a) shows the voltage waveform of an individual electrode 109 in a matrix with n rows and m columns; (b) shows the voltage waveform of the common electrode 110; (c) shows the voltage between the common electrode 110 and the individual electrode 109 (solid line) and the wall voltage (broken line); and (d) shows the waveform of light emission. In the timing chart of FIG. 8, first is the wall-voltage generation period, which is followed by the display period. The wall-voltage generation period comes for example once in every 60 frames, i.e., once per second, wherein the voltage Va and the wall-voltage generation voltage −Vrs are applied to the individual electrode 109 and the common electrode 110, respectively. This generates a voltage of (Va+Vrs) across the electrodes, thus inducing discharge. As previously described, the pulse voltage applied to the common electrode 110 changes gently from its peak value to the baseline (cf. (b) of FIG. 8). During the display period, the sustain voltages Vs, −Vs are alternately applied to the common electrode 110 in predetermined cycles. A cycle between the rising edges of the sustain voltage Vs is referred to as a "sustain pulse cycle". When the voltage Va is applied in the display period, the pulse applied to the individual electrode 109 is a pulse which rises to the voltage Va just before the voltage at the common electrode 110 rises to the sustain voltage Vs, and falls to the voltage GND immediately after the rising edge of the sustain voltage (−Vs). During the application of the voltage Va to the individual electrode 109, no discharge or light emission occurs. The pulse applied to the individual electrode 109 has a pulse width of about 0–255 times a multiple of the sustain pulse cycle.

Figure 9:
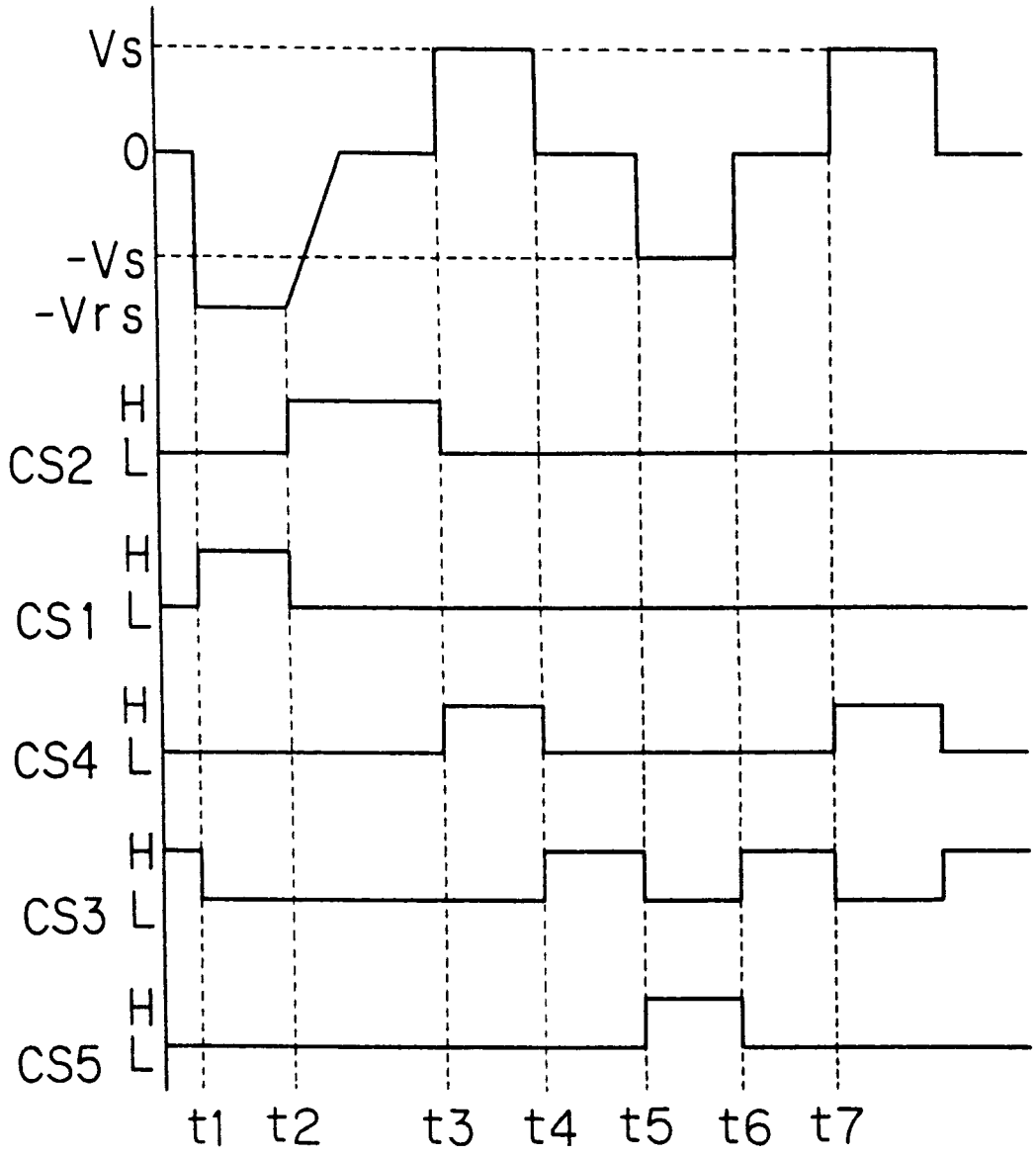
FIG. 9 is a timing chart showing the operation of the common-electrode driving circuit at the output of the voltage in FIG. 8.

Referring now to the timing chart of FIG. 9, we will describe the operation of the common-electrode driving circuit at the output of the voltage in (b) of FIG. 8. Just before time t1, only the control signal CS3 is at its high level out of the control signals CS1 to CS5, and the NMOS transistor M5 is in its on state out of the NMOS transistors M3 to M9. Accordingly, the ground voltage GND is applied via the NMOS transistor M5 and the diode D2 to the common electrode 110. During times t1–t2, the control signal CS3 goes low and the control signal CS1 goes high, whereby the NMOS transistor M5 is turned off and the NMOS transistor M3 is turned on. Accordingly, the wall-voltage generation voltage (−Vrs) is applied via the NMOS transistor M3 to the common electrode 110. During times t2–t3, the control signal CS1 goes low and the control signal CS2 goes high, whereby the NMOS transistor M3 is turned off and the NMOS transistor M4 is turned on. Accordingly, the ground voltage GND is applied via the resistance R, the diode D1, and the NMOS transistor M4 to the common electrode 110. At this time, the voltage at the common electrode 110 changes gently since the ground voltage GND is applied via the resistance R. During times t3–t4, the control signal CS2 goes low and the control signal CS4 goes high, whereby the NMOS transistor M4 is turned off and the NMOS transistor M6 is turned on. Accordingly, the sustain voltage Vs is applied via the NMOS transistor M6 to the control electrode 110. During times t4–t5, the control signal CS4 goes low and the control signal CS3 goes high, whereby the NMOS transistor M6 is turned off and the NMOS transistors M5, M7 are turned on. Accordingly, current flows from the common electrode 110 through the diode D2 and the NMOS transistor M5, which changes the voltage at the common electrode 110 to the ground voltage GND. During times t5–t6, the control signal CS3 goes low and the control signal CS5 goes high, whereby the NMOS transistors M5, M7 are turned off and the NMOS transistors M8, M9 are turned on. Accordingly, current flows from the common electrode 110 through the diode D4 and the NMOS transistor M8, which changes the voltage at the common electrode 110 to the sustain voltage (−Vs). During times t6–t7, the control signal CS5 goes low and the control signal CS3 goes high, whereby the NMOS transistors M8, M9 are turned off and the NMOS transistors M5, M7 are turned on. Accordingly, current flows through the NMOS transistor M7 and the diode D3 to the common electrode 110, which changes the voltage at the common electrode 110 to the ground voltage GND. The repetition of the above operations (during t3–t7) allows the output of the bipolar pulse which alternates in amplitude between the two different sustain voltages Vs, −Vs.

Figure 10:
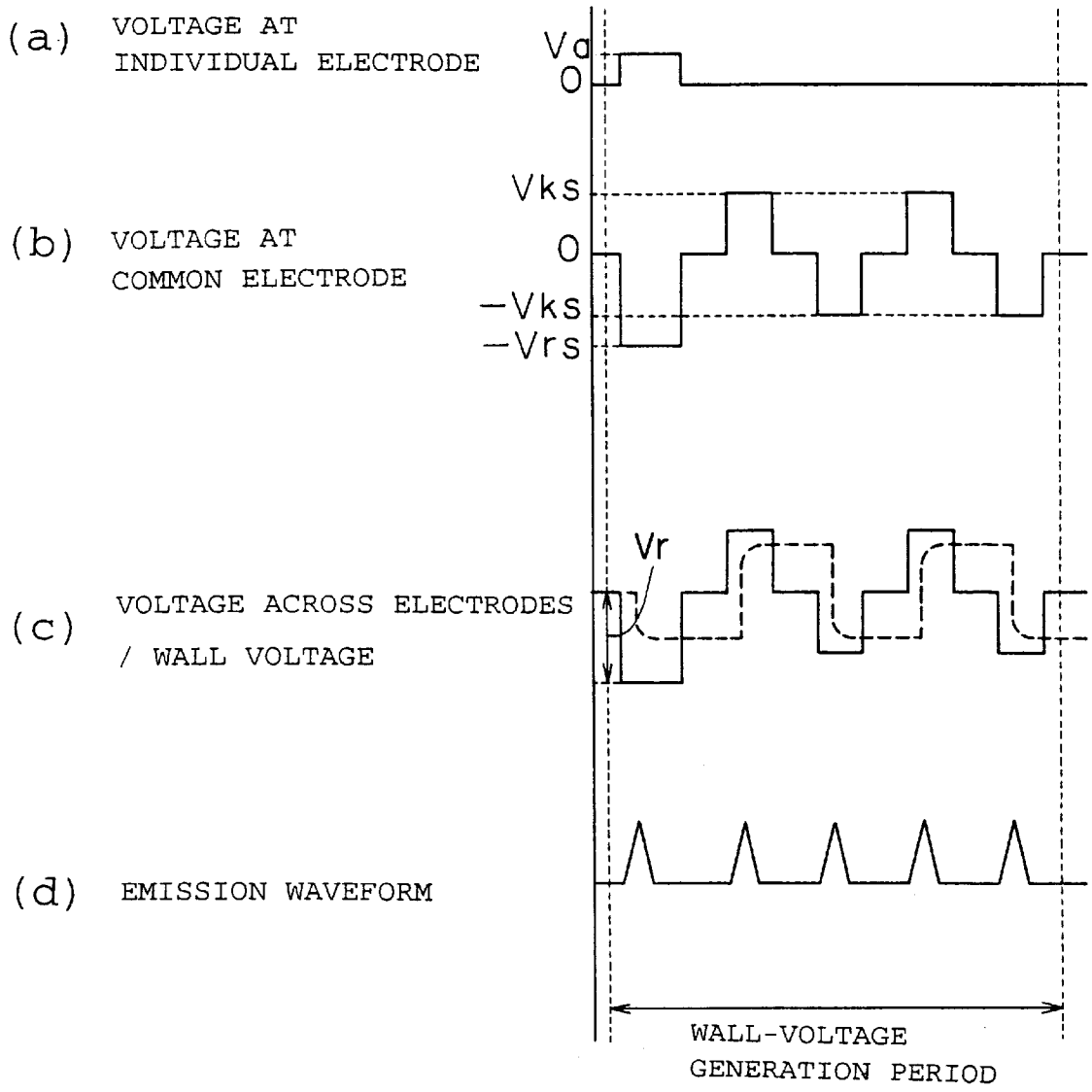
FIG. 10 is a timing chart to explain another driving waveforms during a wall-voltage generation period.

Referring now to FIG. 10, we will describe another driving waveforms during the wall-voltage generation period. In FIG. 10, only the wall-voltage generation period is shown since the waveforms during the display period are identical to those in FIG. 8. Here, (a) shows the voltage waveform of an individual electrode 109 in the matrix with n rows and m columns; (b) shows the voltage waveform of the common electrode 110; (c) shows the voltage between the common electrode 110 and the individual electrode 109 (solid line) and the wall voltage (broken line); and (d) shows the waveform of light emission. First, a voltage equal to a sum of the absolute values of the address voltage Va and the wall-voltage generation voltage Vrs is applied across the electrodes (see (c) in FIG. 10). The pulse voltage applied to the common electrode 110 thus has an amplitude of the wall-voltage generation voltage (−Vrs). After the wall-voltage generation voltage −Vrs is applied, two cycles of the alternating pulse which starts from the positive polarity and has an amplitude of Vks is applied to generate a wall voltage. Here the voltage Vks is smaller than the voltage Vrs. Although this alternating pulse increases the number of light emissions during the wall-voltage generation period, this is one of the best ways to generate the same amount of wall charge as in the display period. In generating a wall voltage in FIG. 8, too much wall charge generated during the wall-voltage generation period becomes a cause to increase the address voltage Va.

Figure 11:
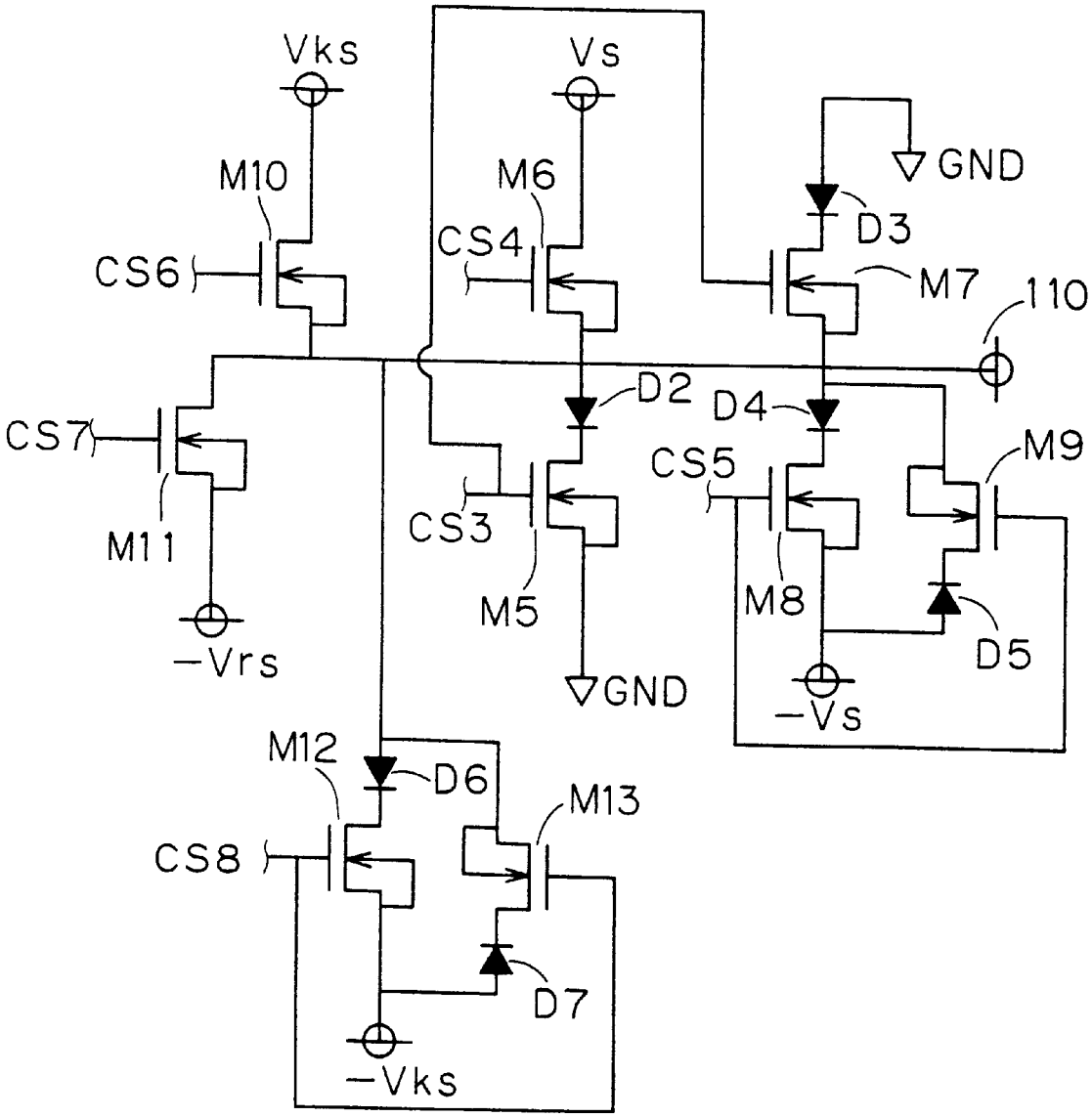
FIG. 11 is a circuit diagram of the common-electrode driving circuit for generating the voltage pulse of FIG. 10.

FIG. 11 shows a common-electrode driving circuit for generating the voltage pulse in the wall-voltage generation period in FIG. 10. The common-electrode driving circuit of FIG. 11 is configured to generate, with any timing, the wall-voltage generation voltage Vrs, the voltage Vks, the sustain voltage Vs, and the ground voltage GND. Now, we will describe the connections between elements in this common-electrode driving circuit. The connections between the common electrode 110, the NMOS transistors M5 to M9, and the diodes D2 to D5 are as shown in FIG. 7 and not described here. In FIG. 11, an NMOS transistor M10 has a source connected to the common electrode 110, a drain to which the voltage Vks is applied, and a gate for receiving a control signal CS6. An NMOS transistor M11 has a drain connected to the common electrode 110, a source to which the wall-voltage generation voltage (−Vrs) is applied, and a gate for receiving a control signal CS7. An NMOS transistor M12 has a drain, a source to which the voltage (−Vks) is applied, and a gate for receiving a control signal CS8. An NMOS transistor M13 has a drain, a source connected to the common electrode 110, and a gate for receiving the control signal CS8. A diode D6 has an anode connected to the common electrode 110 and a cathode connected to the drain of the NMOS transistor M12. A diode D7 has a cathode connected to the drain of the NMOS transistor M13 and an anode to which the voltage (−Vks) is applied.

Figure 12:
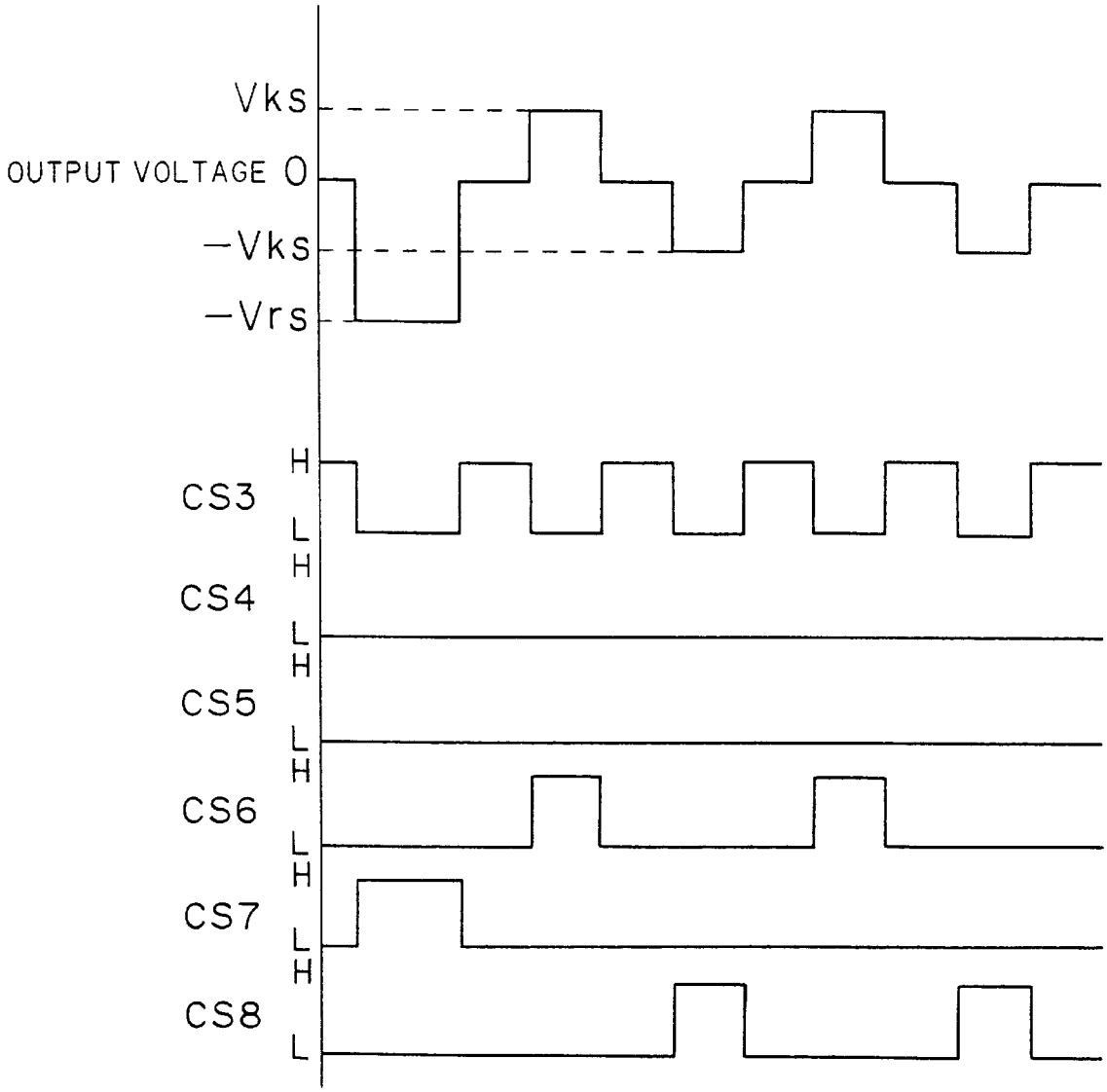
FIG. 12 is a timing chart associated with control signals CS3 to CS8 for controlling NMOS transistors M5 to M13 in FIG. 11.

FIG. 12 is a timing chart of the control signals CS3 to CS8 for controlling the NMOS transistors M5 to M13 of FIG. 11 so that the common-electrode driving circuit can obtain the output shown in (b) of FIG. 10. Here only the control signals CS3 to CS8 during the wall-voltage generation period is described. When the output of the common-electrode driving circuit is 0 V, only the control signal CS3 is at its high level. The control signals CS4, CS5, which are not necessary during the wall-voltage generation period, are at their low level. The control signal CS6 goes high only at the output of the voltage Vks. The control signal CS7 goes high only at the output of the wall-voltage generation voltage Vrs. The control signal CS8 goes high only at the output of the voltage (−Vks).

In FIG. 12, two cycles of the sustain pulse having a voltage Vks in amplitude is applied during the wall-voltage generation period. The voltage Vks may be the same in value as the sustain voltage Vs, but it is set lower than the sustain voltage Vs of over 200V. This is for the purpose of stabilizing the operation. When the voltage Vs is equal to the voltage Vks, the time of the voltage Vks is set longer than that of the voltage Vs during the display period to stabilize the operation.

As above described, some consideration is given for the value and time of the voltage pulse applied during the wall-voltage generation period. This is to prevent the occurrence of discharge emission at the falling edge of the voltage pulse of positive polarity and at the rising edge of the voltage pulse of negative polarity. If such discharge occurs during the wall-voltage generation period, the amount of wall voltage is reduced and thus the margin of voltage during the display period is reduced.

Figure 13:
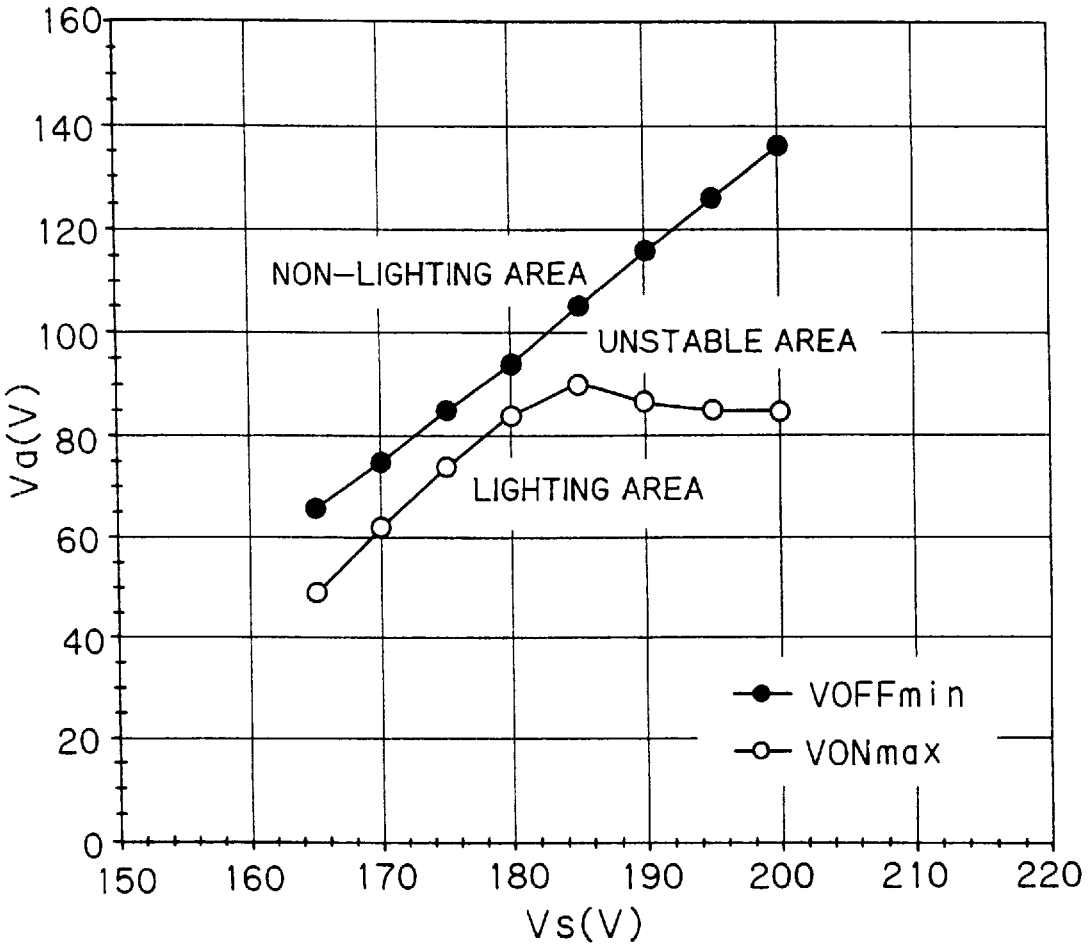
FIG. 13 is a graph showing the relationship between the address voltage and the sustain voltage in the display panel.

FIG. 13 shows the characteristics of the address voltage on an 8- by 8-pixel panel offering a 10-nm dot pitch. As in the ac discharge type PDP, discharge gas is mixed gas of neon and xenon (Ne—Xe). The horizontal and vertical axes indicate the sustain voltage Vs and the address voltage Va, respectively. Here the operating characteristics during the display period (i.e., while the wall voltage is kept in discharge cells) is shown. The sustain frequency is set at 5 kHz, but the same characteristics is obtained even at the sustain frequency of 25 kHz. In the drawing, the open circle indicates the upper limit Von for light emission from the display panel, and the closed circle indicates the lower limit Voff for no light emission. The area below the open circles is a lighting area and the area above the closed circles is a non-lighting area. Referring to FIG. 13, for no light emission, the address voltage Va is set to about 100 V when the sustain voltage Vs is 180 V in the display device of the first preferred embodiment. This address voltage Va of 100V applied across the electrodes during the address operation is considerably lower than the voltage of 230 V in the conventional ac discharge type display device. Here it is noted that not all the area above the closed circles in FIG. 13 is the non-lighting area; in practice, there is the upper limit. When the voltage across the electrodes (i.e., Vs+Va−Vw) exceeds the firing voltage Vgf, discharge emission occurs as previously described.

Second Preferred Embodiment

According to the display device of the first preferred embodiment with reference to FIGS. 1 to 3, the constant wall voltage Vrs is kept in the discharge cells 104 and the address voltage Va is controlled so that the sum of the wall voltage Vrs and the sustain voltages Vs, −Vs (i.e., |Vrs|+|Vs|) does not exceed the firing voltage Vgf. The thickness of the dielectric layer 112*a*, the sustain voltages Vs, −Vs, and the firing voltage Vgf (determined by discharge gap and gas) in the discharge space vary little according to the cell positions in the display panel. Those constant values determines the wall voltage, so the margin is stable in the display device of the first preferred embodiment. The driving margin of the conventional ac discharge type display device, on the other hand, is narrow and unstable since the margin is determined by the wall voltage which is unevenly left in each cell after erasing. In the conventional ac discharge type display device, the rising and falling edges of the erase pulse have great influences over the wall-charge erasing characteristics and the impedance of each cell varies according to its position in the display panel. Therefore, it is difficult to erase the wall charge irrespective of the cell positions.

The margin is stable in the display device of the first preferred embodiment. When the sustain voltage (−Vs) is applied to the common electrode 110, the voltage (Va+Vs) is applied across the electrodes. Thus, the voltage (Va+Vs−Vw), where Vw=wall voltage, may exceed the firing voltage Vgf depending on the address voltage Va. When the sustain voltage Vs is applied, the voltage in the discharge cells is given by (Vs+Vw−Va). Thus, the higher the address voltage Va, the greater is the effect of stopping discharge. In the display device of the first preferred embodiment, however, there is the upper limit for the address voltage Va. A display device comprising a display panel using ac discharge according to a second preferred embodiment of the present invention can resolve the above problem.

Figure 14:
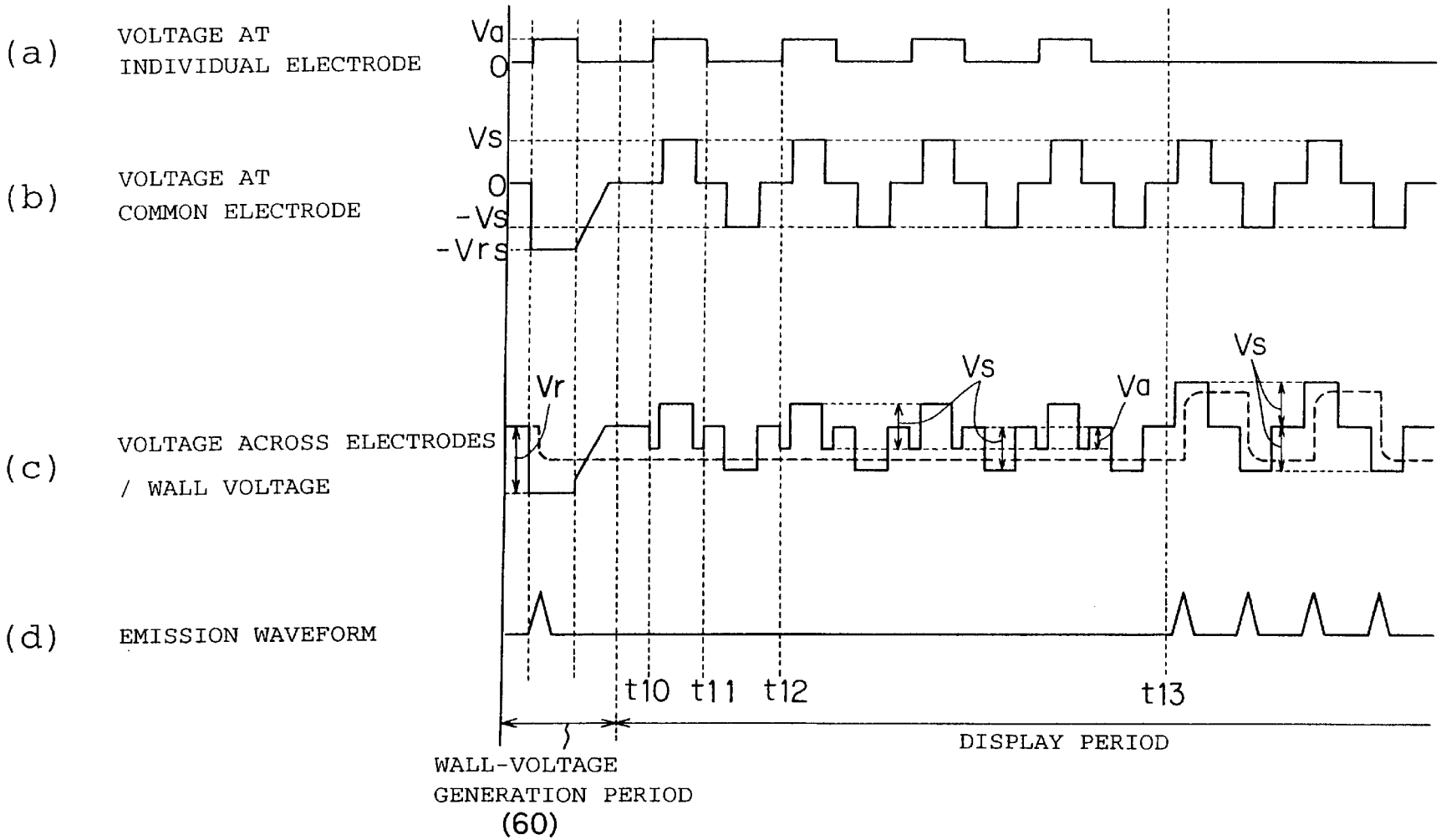
FIG. 14 is a timing chart to explain how to drive a display panel using ac discharge according to a second preferred embodiment of the present invention.

Referring now to FIG. 14, the display device of the second preferred embodiment is described. In FIG. 14, (a) shows the voltage waveform of an individual electrode 109 in the matrix with n rows and m columns; (b) shows the voltage waveform of the common electrode 110; (c) shows the voltage between the common electrode 110 and the individual electrode 109 (solid line) and the wall voltage (broken line); and (d) shows the waveform of light emission.

The display device of the second preferred embodiment is characterized in that the driving waveform of the individual electrode 109 differs from that in the first preferred embodiment. Referring to the driving pulse of the individual electrode 109 during times t10–t13 when light emission should be stopped, the address voltage Va is applied only when the sustain voltage Vs is applied. That is, no address voltage Va is applied when the sustain voltage (−Vs) is applied. Accordingly, the voltage at the individual electrode 109 becomes 0 V before and after the period while the sustain voltage pulse (−Vs) is applied (e.g., times t11–t12). By varying the driving waveform of the individual electrode 109 in this fashion, no other voltage is applied across the electrodes during the application of the sustain voltage (−Vs). The voltage in the discharge cells 104 for the sustain pulse of positive polarity is given by (Vs+Vw−Va) as in the first preferred embodiment, and that for the sustain pulse of negative polarity is given by (Vs−Vw). More specifically, as shown in (e) of FIG. 14, the baselines of both the pulse of positive polarity and the pulse of negative polarity are shifted by the voltage Va. At this time, a difference between the maximum and minimum values of the voltage applied between the individual electrode 109 and the common electrode 110 is smaller than the same difference of the bipolar pulse applied to the common electrode 110. The margin Vmg of the address voltage is larger than the lower limit Voff which is determined by the value of the sustain voltage Vs. This considerably increases the operating margin. Of course, the driving waveform during the wall-voltage generation period may be the one shown FIG. 10, instead of that of FIG. 14.

Third Preferred Embodiment

According to the relationship between the sustain voltage and the address voltage in the display panel of the first preferred embodiment, for no light emission, the address voltage Va can be set at 100 V when the sustain voltage Vs is 180 V. The display panel is in the condition of light emission when the address voltage Va is 80 V, for example. That is, light emission/no light emission from the panel can be controlled by controlling the address voltage between 80–100 V. A display device comprising a display panel using ac discharge according to a third preferred embodiment utilizes discharge characteristics to lower the address voltage Va. Because of a large number of individual electrodes 109 to which the address voltage Va should be applied, individual-electrode driving circuits are integrated. In the integrated individual-electrode driving circuits, the number of output pins and the IC size (i.e., circuit cost) are determined by the IC withstand voltage. That is, the cost increases with the IC withstand voltage. Therefore, reduction in the voltage of the multi-output individual-electrode driving circuits has the effect of considerably reducing the cost of the display device.

Figure 15:
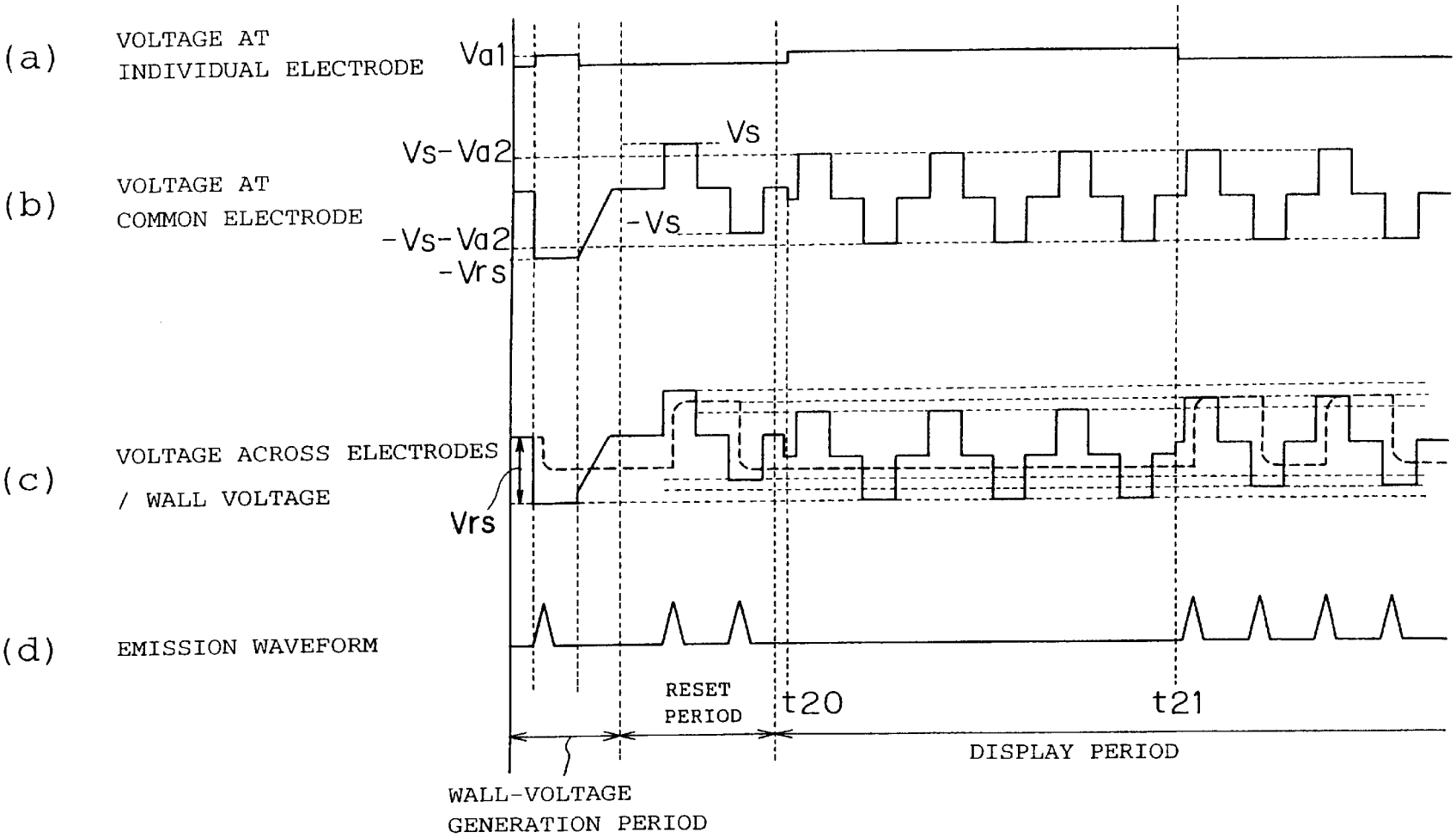
FIG. 15 is a timing chart to explain how to drive a display panel using ac discharge according to a third preferred embodiment of the present invention.

Referring now to FIG. 15, we will described the display device of the third preferred embodiment. In FIG. 15, (a) shows the voltage waveform of an individual electrode 109 in the matrix with n rows and m columns; (b) shows the voltage waveform of the common electrode 110: (c) shows the voltage between the common electrode 110 and the individual electrode 109 (solid line) and the wall voltage (broken line); and (d) shows the waveform of light emission. The timing chart of FIG. 15 shows the waveforms during the wall-voltage generation period, the reset period, and the display period.

First is the wall-voltage generation period once in every 60 frames (per second). In each frame, the reset period is provided before the display period. The reset period and the display period are then repeated. In frames with no wall-voltage generation period, the reset and display periods are repeated. During the reset period, the address voltage Va is 0 V (GND) and the bipolar sustain voltage Vs, −Vs which starts from the positive polarity is applied to the common electrode 110 in the same cycle as in the display period. In the reset period, a wall voltage with 0 V as a basis is generated in the discharge cells 104. In the next display period, the baseline of the sustain voltage pulse Vs, −Vs applied to the common electrode 110 is lowered from 0 V by −Va2. This shifting is performed at time t20 which is before the application of the sustain voltage Vs and after the application of the sustain voltage (−Vs) at the end of the reset period. In accordance with this timing, an address voltage Va1 is applied only for times t20–t21 to stop light emission. Of course, such a period of no light emission may be provided a plurality of times during the display period. By the application of the address voltage Va1, the voltage in the discharge cells 104 becomes (Vs+Vw−Va1−Va2). Since the voltage in the discharge cells 104 is set lower than the firing voltage Vgf in the period of no light emission, discharge emission stops. Discharge emission occurs again when the address voltage Va1 applied to the individual electrode 109 becomes 0 V. When the sustain voltage Vs is 180 V and the address voltage necessary for the address operation is 100 V, for example, the address voltage Va1 should only be 20 V by assigning the remaining 80 V to the above voltage Va2.

A first discharge induced just after the address voltage Va1 becomes 0 V produces weak discharge emission since the voltage in the discharge cells 104 is (Vs−Va2+Vw). At this time, the baseline of the wall voltage is zero. From a second and later discharges, the wall voltage Vw and the sustain voltage Vs have the same baseline of −Va2 in amplitude and the voltage in the discharges cells becomes (Vs+Vw). Thus, the steady intensity of light emission occurs. After the display period is completed and the sequence comes to the top of another frame, reset discharge is induced to return the baseline of the wall voltage back to zero.

Figure 16:
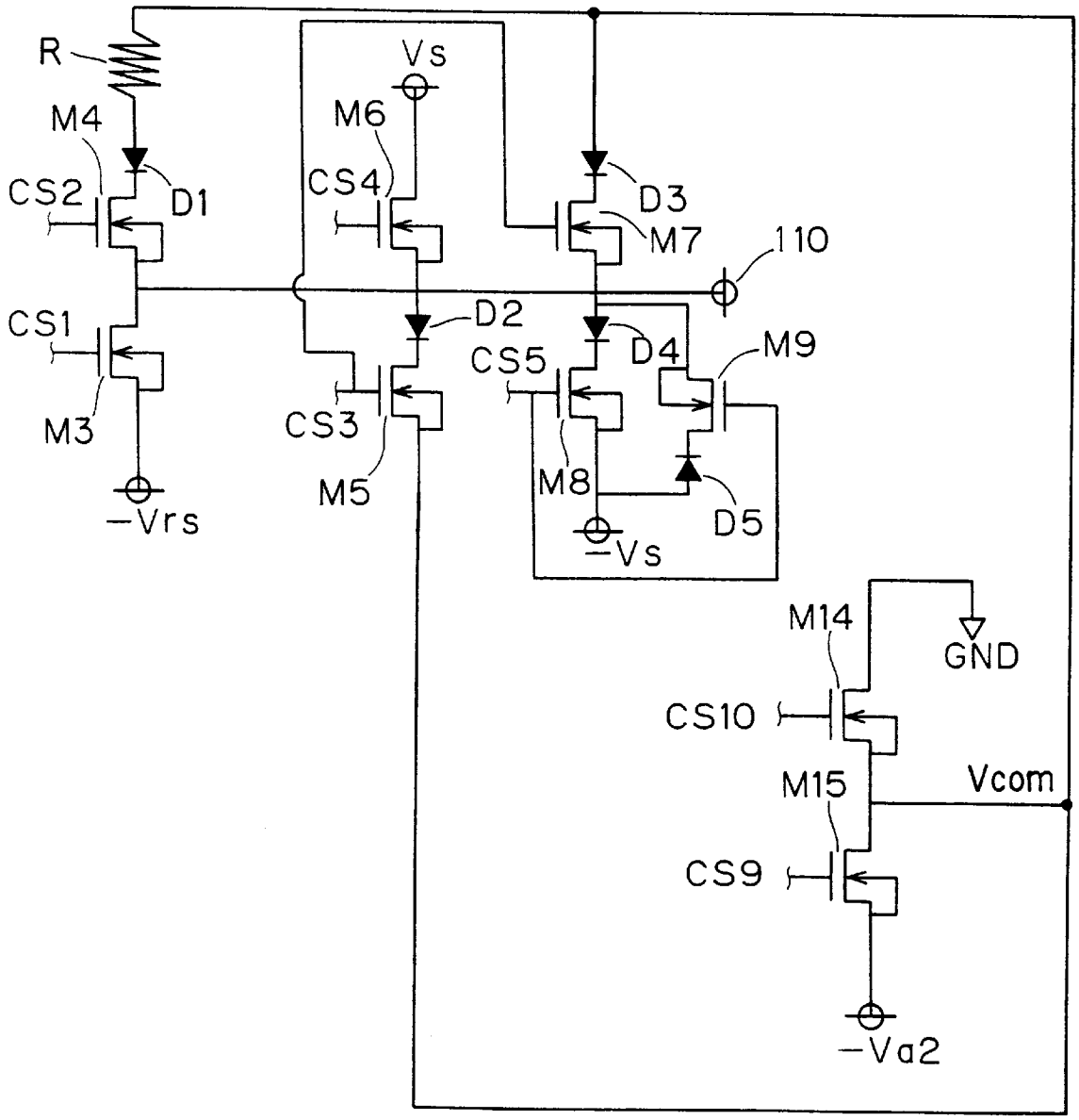
FIG. 16 is a circuit diagram showing an example of a common-electrode driving circuit in the third preferred embodiment.
Figure 17:
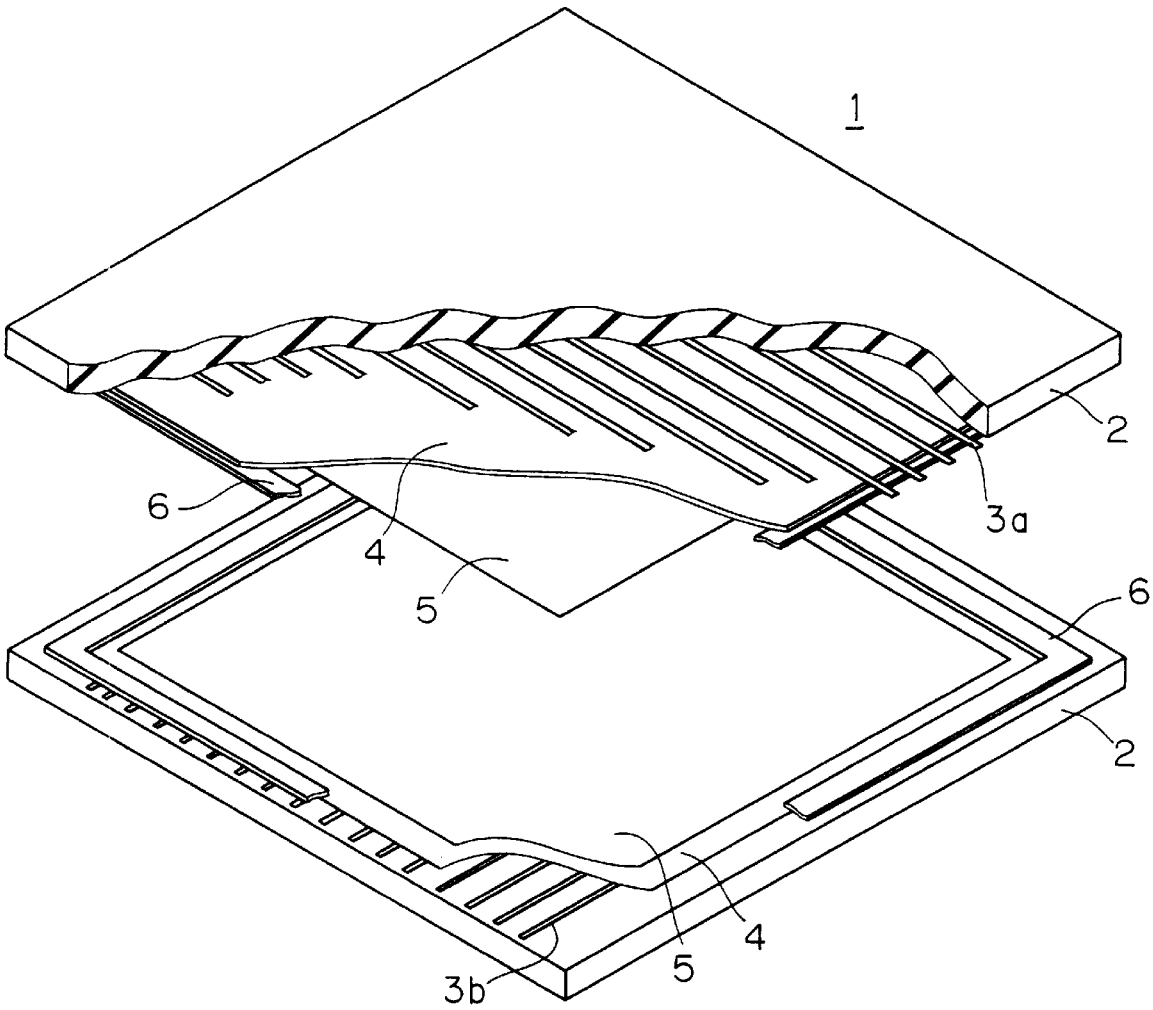
FIG. 17 (PRIOR ART)
FIG. 17 is an exploded perspective view showing the structure of a conventional display panel using ac discharge.
Figure 18:
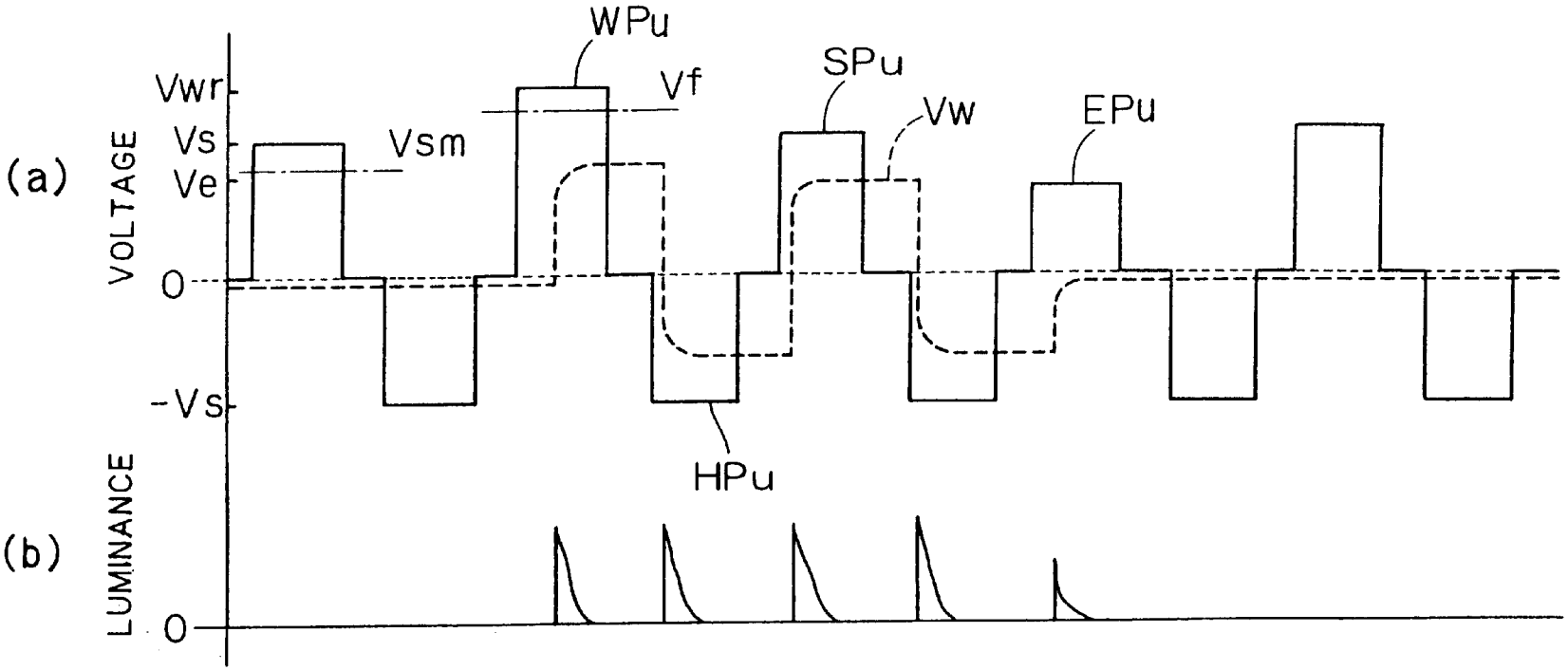
FIG. 18 (PRIOR ART)
FIG. 18 is a timing chart to explain a conventional driving principle of a display panel using ac discharge.
Figure 19:
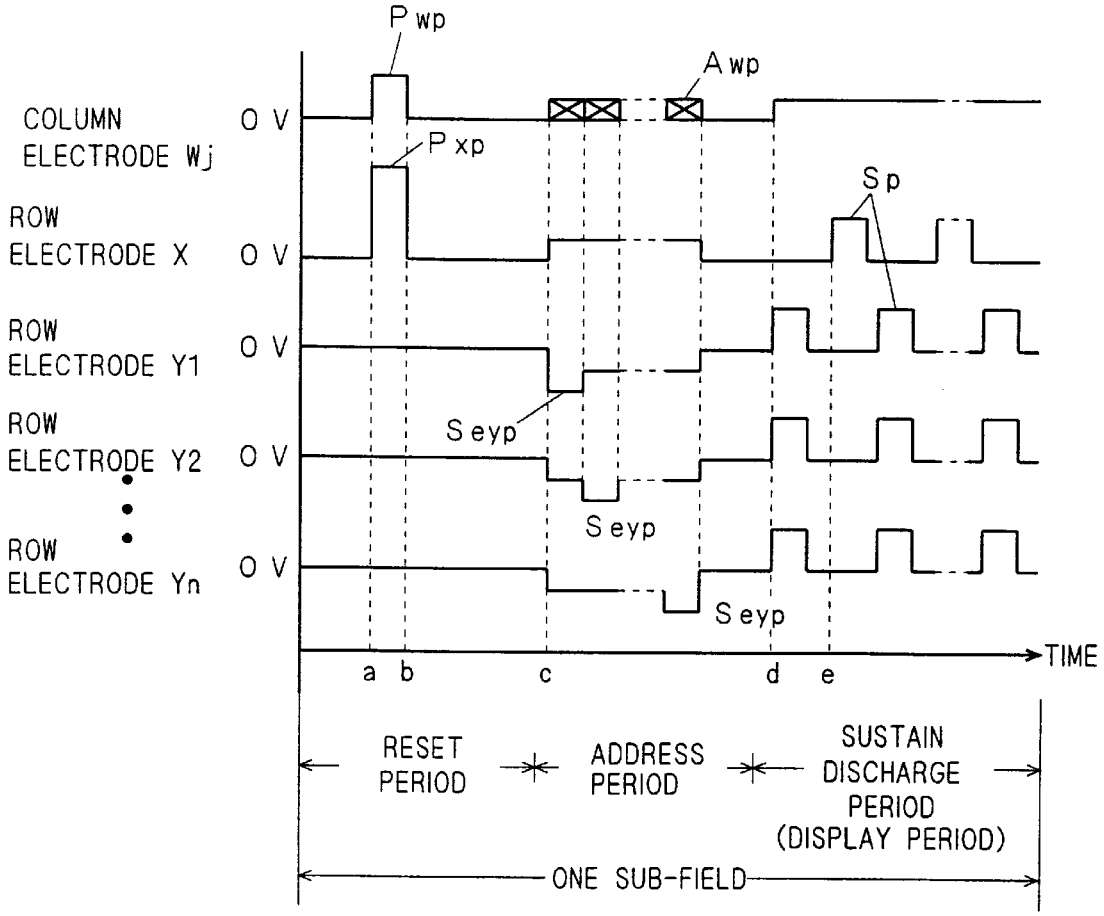
FIG. 19 (PRIOR ART)
FIG. 19 shows the voltage waveforms across electrodes to explain a conventional driving principle of a three-electrode surface discharge type ac PDP.

FIG. 16 shows an example of a common-electrode driving circuit used in the third preferred embodiment. The individual-electrode driving circuits are identical in configuration to those of the first and second preferred embodiments. The terminals of the aforementioned common-electrode driving circuit (FIG. 7) to which the ground voltage GND is applied receive a voltage Vcom which is supplied from a circuit consisting of two NMOS transistors M14, M15 in FIG. 16. Such a circuit can output two levels of voltages GND, −Va2. The terminals to which the ground voltage GND is applied in FIG. 7 are the other end of the resistance R, the source of the NMOS transistor M5, and the anode of the diode D3.

In the third preferred embodiment, the voltage applied to the individual electrode 109 in the address operation (for no light emission) is lowered by applying the bias voltage of −Va2 to the common electrode 110. The same effect can also be obtained by applying the bias voltage of −Va2 to the individual electrode. That is, the voltage applied to the individual electrode 109 should have the baseline which is shifted by −Va2 and the pulse amplitude of Va1. However, in order to lower the withstand voltage of the circuits relevant to the individual electrodes 109, the structure of the third preferred embodiment is more preferable than the alternative. It is also possible to combine the third and second preferred embodiments.

While the invention has been shown and described in detail, the foregoing description is in all aspects illustrative and not restrictive. It is therefore understood that numerous modifications and variations can be devised without departing from the scope of the invention.

What is claimed is:

1. A display device comprising:

a display panel using AC discharge; and a driving circuit, wherein said display panel includes a discharge cell provided with a first electrode and a second electrode covered with a dielectric, said first and second electrodes being connected to said driving circuit and said driving circuit being configured to apply voltages to said first and second electrodes including a sustain voltage applied to said first electrode in the presence of a wall voltage stored by said discharge cell to cause light emission from said discharge cell by inducing AC gas discharge, said driving circuit being further configured to apply voltages across said first and second electrodes to prevent said AC gas discharge light emission from occurring in said discharge cell without erasing said wall voltage, even if said sustain voltage is applied to said first electrode.

2. The display device according to claim 1, wherein said driving circuit is further configured to initially provide said wall voltage stored by said discharge cell by applying a voltage higher than a firing voltage across said first and second electrodes once in a predetermined number of displayed frames.

3. The display device according to claim 2, wherein said wall voltage stored by said discharge cell results from said driving circuit applying a single voltage pulse which changes gently from a peak value to a baseline.

4. The display device according to claim 2, wherein said wall voltage stored by said discharge cell results from said driving circuit applying a first voltage pulse having a voltage higher than said firing voltage and a second bipolar voltage pulse which is applied by said driving circuit following said first voltage pulse, with said second bipolar voltage pulse having an amplitude lower than said first voltage pulse.

5. The display device according to claim 1, wherein said driving circuit is further configured to switch between causing said AC gas discharge light emission and preventing said AC gas discharge light emission by shifting a baseline of a bipolar voltage pulse which is applied across said first and second electrodes.

6. The display device according to claim 5, wherein said driving circuit is further configured to apply voltages to prevent said AC gas discharge light emission for a period of time about an integral multiple of a cycle of said bipolar voltage pulse.

7. The display device according to claim 6, wherein said driving circuit is further configured to apply voltages to start a condition where said baseline is shifted by a predetermined value between a end of a voltage pulse of one polarity and a beginning of a voltage pulse of opposite polarity, and after said period of time, terminating said condition between said end of a voltage pulse of one polarity and said beginning of a voltage pulse of said opposite polarity, with said voltage pulse of one polarity and said voltage pulse of said opposite polarity constituting said bipolar voltage pulse.

8. The display device according to claim 6, wherein said driving circuit is further configured to apply voltages varying said baseline so that a baseline of a voltage pulse of one polarity takes a first value and a baseline of a voltage pulse of opposite polarity takes a second value, with said voltage pulse of one polarity and said voltage pulse of said opposite polarity constituting said bipolar voltage pulse, and with said first and second values being set to minimize a difference between a maximum value and a minimum value of said bipolar voltage pulse.

9. The display device according to claim 8, wherein said varying said baseline so that a baseline of a voltage pulse of one polarity takes a first value and a baseline of a voltage pulse of said opposite polarity takes a second value is performed between the end of a voltage pulse of one polarity and the beginning of a voltage pulse of said opposite polarity.

10. A display device according to claim 5, wherein said driving circuit is further configured to apply voltages so that said baseline is shifted by varying a voltage applied to either of said first and second electrodes.

11. The display device according to claim 5, wherein said driving circuit is further configured to apply voltages so that said baseline is shifted by varying voltages applied to said first and second electrodes.

12. The display device according to claim 11, wherein said driving circuit is further configured to apply voltages so that a voltage applied to said second electrode varies, during the prevention of said AC gas discharge light emission and a voltage applied to said first electrode is varied by a corresponding amount.

13. The display device according to claim 12, wherein said driving circuit is further configured to apply voltages so that a baseline of the amplitude of said wall voltage is reset to 0V.

14. The display device according to claim 12, wherein said driving circuit is further configured to apply voltages so that said sustain voltage is applied to said first electrode which is provided in common to a plurality of discharge cells.

15. A method of driving a display panel using ac discharge which includes a discharge cell provided with a first electrode and a second electrode covered with a dielectric and causing light emission from said discharge cell by inducing ac gas discharge by said first and second electrodes, said method comprising the steps of:

(a) causing a discharge emission in said discharge cell by applying a sustain voltage to said first electrode by the use of a wall voltage generated in said discharge cell; and (b) preventing said discharge emission from occurring in said discharge cell without erasing said wall voltage, even if said sustain voltage is applied to said first electrode.

* * * * *